US006007191A

United States Patent [19]

Fujii et al.

[11] Patent Number: 6,007,191

[45] **Date of Patent: *Dec. 28, 1999**

[54] INK SUPPLY UNIT

[75] Inventors: Katsuyuki Fujii; Junichi Yoshida, both of Ebina, Japan

[73] Assignee: Fuji Xerox Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/602,325

[22] Filed: Feb. 16, 1996

Related U.S. Application Data

[63] Continuation-in-part of application No. 08/291,554, Aug. 16, 1994.

[30] Foreign Application Priority Data

| | | | |
|---|---|---|---|
| Aug. 19, 1993 | [JP] | Japan | 5-226494 |
| Sep. 22, 1993 | [JP] | Japan | 5-259138 |
| Sep. 30, 1993 | [JP] | Japan | 5-269900 |
| Feb. 17, 1995 | [JP] | Japan | 7-029010 |

[51] Int. Cl.[6] ..... B41J 2/175

[52] U.S. Cl. ..... 347/87

[58] Field of Search ..... 347/85–87, 92, 347/93

[56] References Cited

U.S. PATENT DOCUMENTS

| | | | |
|---|---|---|---|
| 3,967,286 | 6/1976 | Anderson et al. | 347/87 |
| 4,422,084 | 12/1983 | Saito . | |
| 4,436,439 | 3/1984 | Koto . | |
| 4,617,581 | 10/1986 | Koto et al. | 347/92 |
| 5,119,115 | 6/1992 | Buat et al. . | |
| 5,158,377 | 10/1992 | Suzuki et al. . | |
| 5,453,771 | 9/1995 | Waseda et al. | 347/86 |
| 5,552,816 | 9/1996 | Oda et al. | 347/86 |

FOREIGN PATENT DOCUMENTS

| | | | |
|---|---|---|---|
| 0 529 879 | 3/1993 | European Pat. Off. . | |
| 536 980 A2 | 4/1993 | European Pat. Off. . | |
| 0 562 733 | 9/1993 | European Pat. Off. . | |
| 605 183 A2 | 7/1994 | European Pat. Off. | 347/86 |
| 57-16385 | 6/1980 | Japan . | |
| 57-2786 | 1/1982 | Japan . | |
| 59-95152 | 6/1984 | Japan . | |
| 60-262654 | 12/1985 | Japan . | |
| 62-35892 | 3/1986 | Japan . | |
| 62-5994 | 1/1987 | Japan . | |
| 63-231759 | 10/1987 | Japan . | |
| A-63-5069 | 1/1988 | Japan . | |
| 64-35215 | 2/1989 | Japan . | |
| 2-34354 | 2/1990 | Japan . | |
| A-3-87266 | 4/1991 | Japan . | |
| 3-41351 | 6/1991 | Japan . | |
| 3-189157 | 8/1991 | Japan . | |
| A-3180357 | 8/1991 | Japan . | |
| 3-258554 | 11/1991 | Japan . | |
| 4-296566 | 10/1992 | Japan . | |
| 6-238908 | 8/1994 | Japan . | |
| 7-068785 | 3/1995 | Japan . | |

*Primary Examiner*—N. Le
*Assistant Examiner*—Judy Nguyen
*Attorney, Agent, or Firm*—Oliff & Berridge, PLC

[57] ABSTRACT

A main ink chamber for housing a capillary member and an intermediate ink chamber are provided, between which a first meniscus formation member is disposed. An ink guide member is in contact with the bottom face of the first meniscus formation member for supplying ink to the first meniscus formation member. The ink guide member is held by ink guide member retainers extending toward the ink guide member from a wall of a communication hole and is kept in contact with the first meniscus formation member. A larger number of the ink guide member retainers are placed on a side of the communication hole closer to a joint port than are placed on a side of the communication hole closer to the intermediate ink chamber. The placement of the ink guide member retainers guides bubbles entering the communication hole through the first meniscus formation member to the intermediate ink chamber to prevent bubbles entering the joint port and reaching the print head.

8 Claims, 16 Drawing Sheets

FIG. 17

| | FILTER MATERIAL, etc. | LINE DIAMETER LENGTH×BREADTH (μ) | TRANSMITTED GRAIN SIZE (μ) | FLUID RESISTANCE AVERAGE DIFFERENCE ($g/cm^4 s$) | PRESSURE LOSS ($cm H_2O$) |
|---|---|---|---|---|---|
| A | SUS TWILLED DUTCH WEAVE 200×1400 | 71×41 | 10 | $10.3\times10^4$ | 4.2 |
| B | SUS TWILLED DUTCH WEAVE 325×2300 | 36×25 | 5 | $56.1\times10^4$ | 23.1 |

FIG. 24
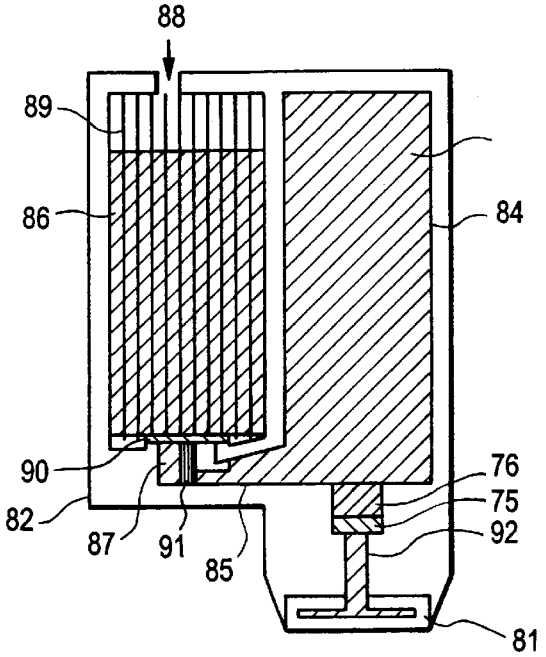
FIG. 25A
FIG. 25B
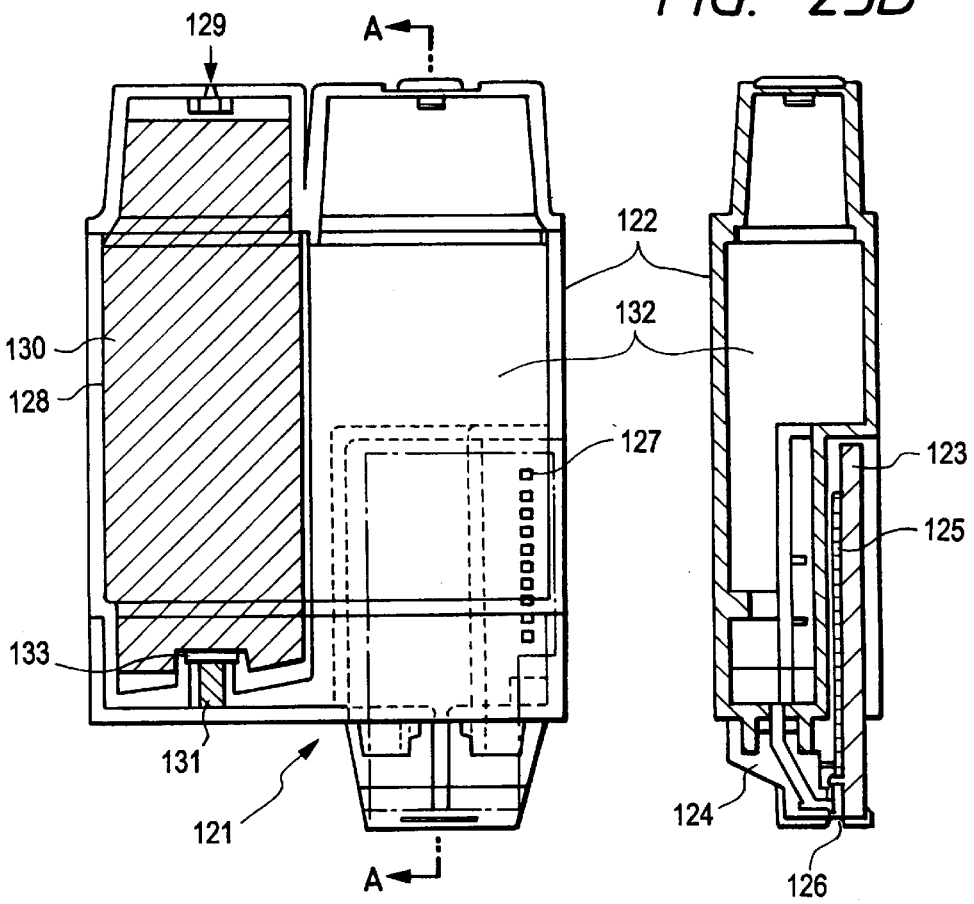

INK SUPPLY UNIT

This application is a continuation-in-part of U.S. application Ser. No. 08/291,554 filed on Aug. 16, 1994. The disclosure U.S. applications Ser. No. 08/601,522 now U.S. Pat. No. 5,821,965 and No. 08/887,263 now U.S. Pat. No. 5,760,806, which are commonly assigned and directed to related subject matter, are incorporated herein by reference.

BACKGROUND OF THE INVENTION

1. Field of Invention

The present invention relates to an ink supply unit for supplying ink to an ink jet head in an ink jet recorder.

2. Description of Related Art

In a conventional ink supply mechanism used with an ink jet recorder, an ink tank contains a porous member with one end coupled to a print head via a filter and the other end formed with an air inlet, for example, as described in Japanese Patent Examined Publication No. Hei 3-41351. In such an ink supply mechanism, air may enter the filter through the space between the porous member and the inner wall of the ink tank, inhibiting ink supply to the ink tank.

To solve such a problem, for example, in Japanese Patent Unexamined Publication No. Hei 2-34354, such a rib abutting an ink absorber is placed on the inner wall face of an ink tank for preventing bubbles from entering a head. However, also in this method, adhesion of the head to a sponge may be poor and air still enters the head along the inner wall face of the ink tank.

As alternative solution means, for example, an air gathering chamber containing a porous member is disposed in anink flow path connecting a print head and an ink vessel for gathering bubbles, as disclosed in Japanese Patent Unexamined Publication No. Sho 57-2786. However, in such a structure, flow path resistance of the porous member itself is large and when bubbles build up on full surfaces of the porous member, flow path resistance increases and ink supply does not keep pace with ink required for responding to high-speed printing.

Further, for example, a filter cloth is stuck on one face of an elastomer plate having a through hole for gathering bubbles on the filter face, as disclosed in Japanese Patent Unexamined Publication No. Sho 59-95152. However, also in this structure, when bubbles build up on full surfaces of the filter cloth, flow path resistance increases and ink supply does not keep pace with ink required for responding to high-speed printing, as in the above-mentioned structure.

Further, for example, a hollow needle is used for a joint connecting an ink tank and a head and a porous substance is disposed in the hollow needle for preventing the entry of bubbles or dust, as disclosed in Japanese Patent Unexamined Publication No. Hei 3-189157. However, in this structure, the inner diameter of the hollow needle needs to be made small virtually to provide a good connection property of the joint. That is, since the opening area of the porous member contained in the hollow needle lessens, flow path resistance increases and ink supply does not keep pace with ink required for responding to high-speed printing.

In such a structure wherein bubbles are trapped on the faces of the porous substance or the filter, it is also possible to enlarge the filter particle size of the porous substance or the filter to decrease the flow path resistance. In this case, for example, if a large amount of ink is consumed because of maintenance, etc., bubbles pass through the porous substance or the filter and enter the print head, causing print failure, etc.

As another art, a method wherein ink is stored in a subtank disposed between an ink tank and a head and is supplied from the subtank to the head is disclosed, for example, in Japanese Patent Laid-Open No. Sho 60-262654. The subtank is opened to the atmosphere and bubbles and ink are separated in the subtank for supplying only ink to the head. However, in this structure, there is a possibility that ink will leak from the atmospheric release port of the subtank and further there is a restriction on design that the head is placed above the subtank to maintain ink pressure at negative pressure.

SUMMARY OF THE INVENTION

It is therefore an object of the invention to provide an ink supply unit for preventing the entry of bubbles into a print head without increasing flow path resistance in an ink supply process from an ink chamber to the print head.

According to the invention, there is provided an ink supply unit for supplying ink to a print head comprising a main ink chamber formed with an atmospheric communication port and a communication hole for supplying ink, a capillary member being housed in the main ink chamber for holding ink, a meniscus formation member being disposed on the communication hole, placed in contact with the capillary member, and formed with a plurality of minute holes, a subordinate ink chamber having a supply part being connected to the communication hole for supplying ink to the print head and an inner wall slanting upward from the connection part to the communication hole, an ink guide member being made of a porous member in contact with the bottom face of the meniscus formation member and extending toward the bottom of the subordinate ink chamber, and a holding member for holding the ink guide member.

In the ink supply unit, the holding member is made up of a plurality of protrusion members extending radially from a side wall of the communication hole and being placed so that the number of the protrusion members placed on the side of the upward slanting inner wall of the subordinate ink chamber is smaller than that of the protrusion members placed on its opposite side.

In the ink supply unit, the supply part is disposed on an opposite side to the upward slanting inner wall with the connection part to the communication hole between.

According to the invention, there is provided an ink supply unit for supplying ink to a print head comprising a main ink chamber formed with an atmospheric communication port and a communication hole for supplying ink, a capillary member being housed in the main ink chamber for holding ink, a meniscus formation member being disposed on the communication hole, placed in contact with the capillary member, and formed with a plurality of minute holes, a subordinate ink chamber being formed with a supply part being connected to the communication hole for supplying ink to the print head and having an inner wall on an opposite side to the supply part with the connection part to the communication hole between slanting upward from the connection part to the communication hole, an ink guide member being made of a porous member in contact with the bottom face of the meniscus formation member and extending toward the bottom of the subordinate ink chamber, and a wall member hanging between the connection part to the communication hole and the supply part.

In the ink supply unit, a wall face between the connection part to the communication hole and the supply part may slant upward from the supply part.

According to the invention, in a state in which the ink supply unit is attached to a recorder, ink is held by the capillary member for keeping negative pressure in a print head. When ink is consumed through the print head, the ink held by the capillary member passes through the meniscus formation member and is supplied from the communication hole through the supply part of the subordinate ink chamber to the print head. If bubbles enter the main ink chamber, they are trapped by the meniscus formation member.

For clogging, etc., normally ink and dust are sucked from the nozzle side. The negative pressure occurring at this time becomes large as compared with the negative pressure occurring in a normal ink supply. At this time, the bubbles on the meniscus formation member may pass through the meniscus formation member together with ink on rare occasion by the large negative pressure. However, since the side wall of the subordinate ink chamber slants upward from the connection part to the communication hole, the bubbles mixed into the ink from the main ink chamber rise along the slant side wall by their buoyant force and are collected. Thus, only the ink is supplied to the print head and no bubbles are mixed into the print head; recording can be continued with a good image quality.

When ink is furthermore consumed and the main ink chamber becomes empty of ink, negative pressure is kept by ink meniscuses formed on the minute holes of the meniscus formation member. That is, as the negative pressure increases, the ink meniscuses are pressed and air passes through as bubbles. The negative pressure decreases as much as the volume of the bubbles. Thus, the negative pressure is kept almost constant. The bubbles passing through the meniscus formation member move along the slant wall face of the subordinate ink chamber by the buoyant force of the bubbles and are collected as described above; no bubbles are mixed into the print head.

At this time, if the bubbles remain on the bottom face of the meniscus formation member, both faces of the meniscus formation member are exposed to air and there is a possibility that the ink amount will decrease, breaking the meniscuses. However, the ink guide member sucks up ink from the subordinate ink chamber and supplies it to the meniscus formation member, whereby the meniscuses formed on the minute holes of the meniscus formation member are not broken.

The ink guide member is placed so as not to close the communication hole so that it does not produce a bottleneck of ink passage or bubble occurrence. Thus, it would fall down very easily without any measures. However, the ink guide member, which is held by the holding member, is kept in contact with the meniscus formation member so as to continue supplying ink to the meniscus formation member.

Although bubbles are trapped by the meniscus formation member, the bubbles passing through the meniscus formation member are collected in the intermediate ink chamber. Therefore, such flow path resistance required for completely preventing the entry of bubbles as before does not exist, and the entry of bubbles into the print head can be prevented without increasing the flow path resistance.

Also, according to the invention, the holding member for holding the ink guide member is made up of a plurality of protrusion members extending radially from the side wall of the communication hole. The protrusion members are placed so that the number of the protrusion members placed on the side of the upward slanting inner wall of the subordinate ink chamber is smaller than that of the protrusion members placed on its opposite side. The bubbles passing through the meniscus formation member and entering the subordinate ink chamber tend to be guided to the side with a smaller number of the protrusion members; such placement causes bubbles to be guided to the side of the slant inner wall and rise along the slope for collection. Thus, the holding member does double duty of holding the ink guide member and guiding bubbles.

Further, according to the invention, the supply part disposed in the subordinate ink chamber is located on the opposite side to the inner wall slanting upward with the connection part to the communication hole between. As described above, bubbles move toward the slanting inner wall by the ink guide member, but the supply part is located on the opposite side to the move direction, whereby the ink flow and the bubble flow can be separated and the mixing of bubbles into the print head can be furthermore decreased.

Still further, according to the invention, in the structure wherein the supply part is disposed on the opposite side to the inner wall slanting upward from the connection part to the communication hole, the wall member hangs between the connection part to the communication hole and the supply part. It can block bubbles attempting to move to the connection part, decreasing the mixing of bubbles into the print head. Of course, the wall member can also be applied to the above-mentioned ink supply units.

Still further, according to the invention, the wall face between the connection part to the communication hole and the supply part is also slanted upward from the supply part, whereby bubbles entering from the supply part can also be moved along the slant wall face for collection. Particularly, in the construction allowing the ink supply unit to be separated from a recorder, when the ink supply unit is attached to the recorder, bubbles can be taken into the ink supply unit from the supply part by a pressurization force at the attachment time for decreasing the air amount into the print head.

BRIEF DESCRIPTION OF THE DRAWINGS

In the accompanying drawings:

FIG. 17 is a table showing characteristics of wire nets of twilled Dutch Weave;

FIG. 24 is a sectional view showing another embodiment of an ink supply device according to the invention;

FIGS. 25A and 25B are schematic structural diagrams showing an ink jet recording unit using the ink supply device of the invention;

DETAILED DESCRIPTION OF PREFERRED EMBODIMENTS

Referring now to the accompanying drawings, a description will be given in detail of preferred embodiments of the invention.

Figure 1:
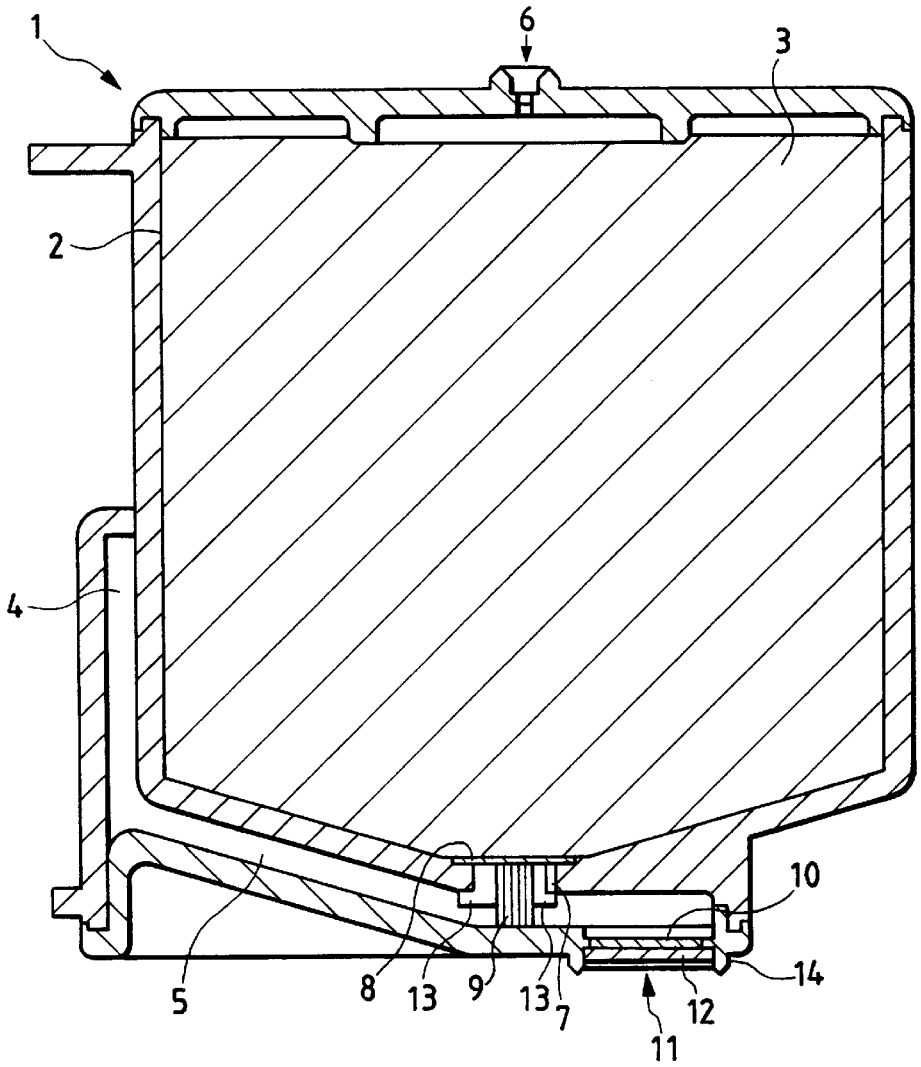
FIG. 1 is a sectional view showing a first embodiment of an ink supply unit of the invention.
Figure 3:
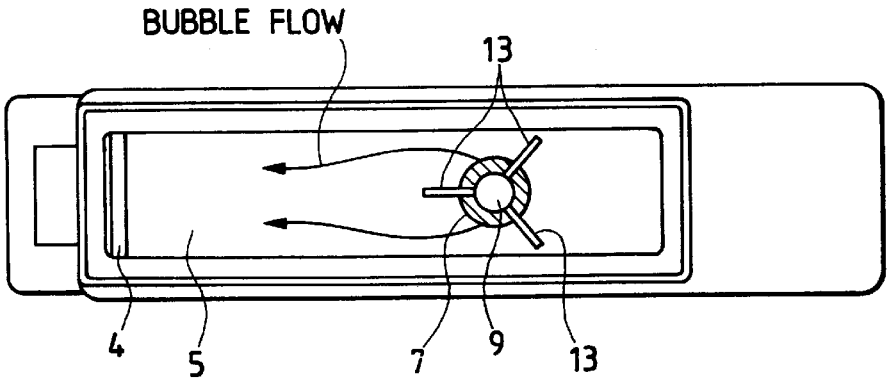
FIG. 3 is a plan view of a communication passage top face in the first embodiment of the ink supply unit of the invention.
Figure 2:
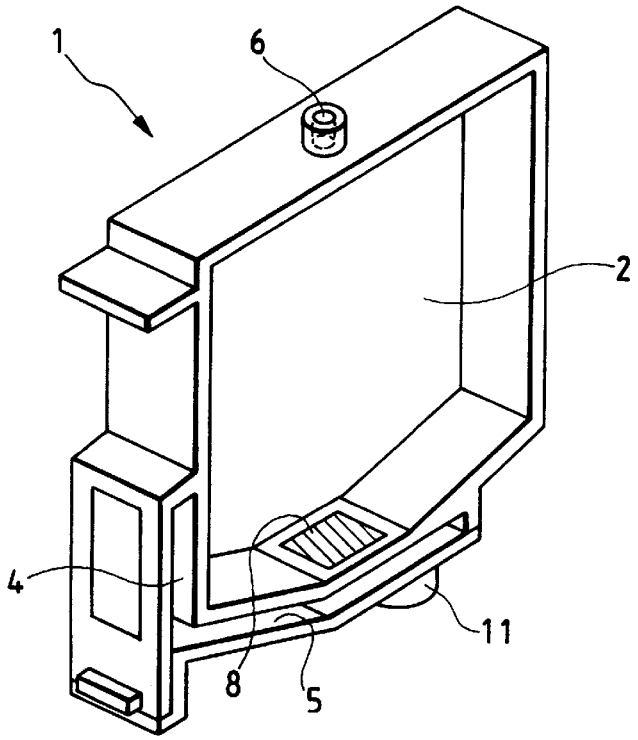
FIG. 2 is a perspective view in section showing the first embodiment of the ink supply unit of the invention.
Figure 4:
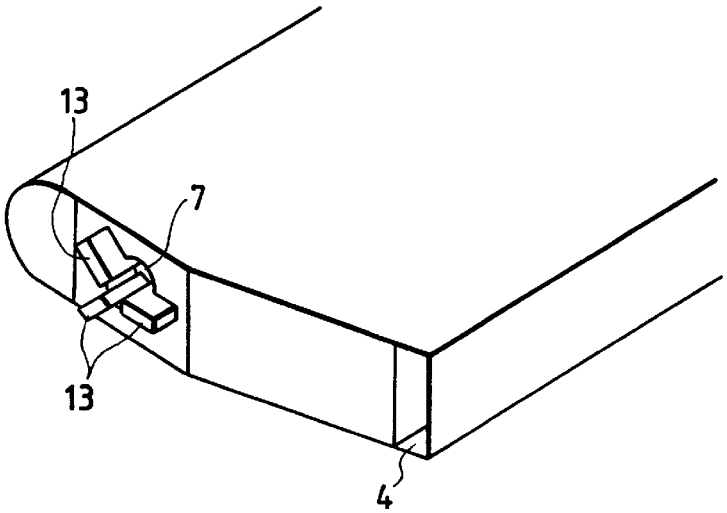
FIG. 4 is a perspective view for explaining an ink guide member retainer in the first embodiment of the ink supply unit of the invention.

FIG. 1 is a sectional view showing a first embodiment of an ink supply unit of the invention. FIG. 2 is a perspective view in section showing the first embodiment of the ink supply unit of the invention. FIG. 3 is a plan view of a communication passage top face in the first embodiment of the ink supply unit of the invention. FIG. 4 is a perspective view for explaining an ink guide member retainer in the first embodiment of the ink supply unit of the invention. In the figures, numeral 1 is an ink tank, numeral 2 is a main ink chamber, numeral 3 is a capillary member, numeral 4 is an intermediate ink chamber, numeral 5 is a communication passage, numeral 6 is an atmospheric communication port, numeral 7 is a communication hole, numeral 8 is a first meniscus formation member, numeral 9 is an ink guide member, numeral 10 is a second meniscus formation member, numeral 11 is a joint port, numeral 12 is an absorption material, numeral 13 is ink guide member retainers, and numeral 14 is a joint outer peripheral portion. This embodiment shows an ink supply unit of separation type from a print head. In FIG. 2, the side wall on the front and the capillary member 3 are excluded.

The ink tank 1 contains the main ink chamber 2 and the intermediate ink chamber 4 on the side thereof. A material which has rigidity and is good in ink resistance for enabling long-term ink holding is selected for the cabinet of the ink tank 1. The ink tank 1 is connected to a print head (not shown) at the joint port 11. Ink in the main ink chamber 2 passes through the communication passage 5 and is supplied via the joint port 11 to the print head.

The communication hole 7 is made in the bottom of the main ink chamber 2, which communicates with the intermediate ink chamber 4 and the joint port 11 via the communication passage 5. The communication hole 7 can be shaped in cross section like a circle, an ellipse, a polygon, a star, a cross, a slit, or the like. The bottom face of the main ink chamber 2 is formed as a slope such that the communication hole 7 is the lowest part.

The capillary member 3 is placed in the main ink chamber 2 for holding ink by a capillary force and maintaining negative pressure. It can be made of a fiber material having a two-dimensional structure, a porous material having a three-dimensional structure, felt comprising a fiber material spun into a three-dimensional form, a nonwoven cloth material, or the like. Specifically, for example, polyester felt comprising polyester fibers spun into a three-dimensional form or a filling material comprising polyester fibers bundled in one direction can be used as the material of the capillary member 3. A material having a density of 0.04 $g/cm^3$–0.1 $g/cm^3$ can be used; a material having a density of the order of such value is preferred from the viewpoints of the capillary force and fluid resistance with respect to ink. The material is not limited to polyester fibers and any other material can be used in accordance with ink if it has a proper capillary force and resists ink.

The surrounding shape of the capillary member 3 is the same as the inside shape of the main ink chamber 2 and the capillary member 3 is inserted into the main ink chamber 2 so that the surroundings of the former come in intimate contact with the side walls of the latter, thereby preventing air introduced from the atmospheric communication hole 6 from entering the main ink chamber 2 along the side walls thereof. The bottom face of the capillary member 3 is formed with a slope having a larger lean than the lean a of the slope made on the bottom face of the main ink chamber 2. Further, only the portion of the capillary member 3 coming in contact with the first meniscus formation member 8 is formed convexly. The capillary member 3 of such a shape is inserted into the main ink chamber 2 so as to come in contact with the whole bottom face of the main ink chamber 2. Then, it is crushed particularly on the first meniscus formation member 8 and the density of the capillary member 3 raises, and lowers gradually with distance from the first meniscus member 8, thereby furthermore blocking air attempting to pass through between the inner face of the main ink chamber 2 and the capillary member 3 and enter the main ink chamber 2 for decreasing the amount of air arriving at the surface of the first meniscus formation member 8 in a state in which ink remains in the main ink chamber 2. A structure wherein the capillary member 3 is not pressed into contact with the first meniscus formation member 8 is also possible, but the capillary member 3 needs at least to be in contact with the first meniscus member 8.

The atmospheric communication port 6 through which the capillary member 3 can communicate with the atmosphere is made in the top of the main ink chamber 2. In the embodiment, the diameter of the atmospheric communication port 6 is made larger than the hole of the capillary member 3 or the gap between fibers. The capillary member 3 communicates with the atmosphere on the top and is released with the atmospheric pressure. When ink is supplied to the print head, the ink in the capillary member 3 is pressed by the atmospheric pressure and is derived from below the capillary member 3 to the communication passage 5 by negative pressure, so that it can be used efficiently. At this time, the negative pressure in the print head is held constant by the capillary force of the capillary member 3. The atmospheric communication port 6 can also be provided with a sheet not passing ink and allowing air to pass through so that ink does not jump out of the atmospheric communication hole 6. Alternatively, it can also be formed with a large number of minute holes through which ink does not flow out.

The first meniscus formation member 8 is placed on the communication hole 7 made in the bottom face of the main ink chamber 2. The bottom of the capillary member 3 is pressed into contact with the first meniscus formation member 8 for placement. The first meniscus formation member 8 can use a mesh substance such as a wire net or resin net, a porous substance, etc., for example. A metal mesh filter, a filter using as a base material a substance comprising metal fibers, for example, SUS fine wires formed like felt and further compressed and sintered, an electro forming metal filter, etc., can be used as specific examples of the mesh substance. For example, a filter of a knitted item of metal or resin fibers like tatami twill or a filter having a highly precise hole diameter made by laser beam machining, electron beam machining, etc., can be used. The form is a circle, a rectangle, or any other form if it can cover the communication hole 7.

When the capillary member 3 is impregnated with ink, the ink passes through the first meniscus formation member 8 and moves to the intermediate ink chamber 4. The first meniscus formation member 8 also prevents unnecessary air from entering the intermediate ink chamber 4 if the capillary member 3 becomes empty of ink. When the ink is furthermore consumed, air coming in through the atmospheric communication port 6 passes through the capillary member 3, pushes meniscuses of ink covering the minute holes made in the first meniscus formation member 8 in contact with the capillary member 3 by an increase in negative pressure in the main ink chamber 2, overcomes the surface tension, and passes through the meniscuses, forming bubbles. The bubbles moves through the communication passage 5 to the intermediate ink chamber 4. The pressure when the bubbles occur (bubble point pressure) depends on the filter particle size of the first meniscus formation member 8. The filter particle size is made optimum, whereby the negative pressure in the ink tank 1, namely, the ink supply pressure to the print head can be held constant. The filter particle size of the first meniscus formation member 8 can range from 40 mm to 70 mm or so, for example.

The ink guide member 9 is placed on the lower face of the first meniscus formation member 8 so as to come in contact with the lower face. It has a cross-sectional dimension smaller than the diameter of the communication hole 7. If bubbles build up on the lower face of the first meniscus formation member 8 and an air layer is formed or the main ink chamber 2 becomes empty of ink and the ink level becomes lower than the height of the communication passage 5, the ink guide member 9 sucks up the ink from the bottom of the communication passage 5 and supplies it to the first meniscus formation member 8, whereby the first meniscus formation member 8 can always be kept in a wet condition and negative pressure can be maintained, whereby the best condition can be maintained until all ink is consumed. The ink guide member 9 may be of any form like a slit, a rectangular parallelopiped, a prism such as a triangle pole, a cylinder, or an elliptic cylinder. More than one ink guide member 9 can also be provided. The ink guide member 9 may be made of any material if the material is capable of pulling up ink to the first meniscus formation member 8 by a capillary force; for example, a filling material comprising polyester fibers bundled in one direction, a porous member of polyurethane, melamine foam, etc., or a two- or three-dimensional fiber structure can be used.

As described above, the ink guide member 9 has a cross section dimension smaller than the diameter of the communication hole 7 so as not to close the communication hole 7 and further extends to the bottom of the communication passage 5. Thus, it is very unstable without any measures and may fall down due to vibration, etc., at the manufacturing or operating time. If the ink guide member 9 falls down, no ink is supplied to the first meniscus formation member 8 and the ink tank 1 becomes unable to be used before ink in the intermediate ink chamber 4 is all consumed.

To circumvent such a problem, the ink guide member 9 is held by a plurality of ink guide member retainers 13 extending in the center direction of the communication hole 7 from the side wall thereof, as shown in FIGS. 3 and 4. Here, three ink guide member retainers 13 are placed as one example. From the viewpoint of pressing the ink guide member 9, it is desirable to form the ink guide member retainers 13 so as to press the ink guide member 9 as long as possible in the length direction thereof. However, to provide the ink flow path, a gap is made between the retainer 13 and the bottom of the communication passage 5. To retain the strength, the ink guide member retainers are also extended to the top face of the communication passage 5 together with the side wall of the communication hole 7. Further, to guide bubbles occurring on the joint port 11 side of the communication hole 7 and bubbles entering through the joint port 11 to the intermediate ink chamber 4, the ink guide member retainers 13 are formed so as not to come in contact with the side walls of the communication passage 5 for providing a bubble flow path. Specifically, when the ink guide member 9 is about 7 mm long, the ink guide member retainer 13 is set to about 5 mm long and the spacing between the retainer 13 and the bottom of the communication passage 5 can be set to about 2 mm. The thickness is set to about 0.5 mm and to ensure the strength, a reasonable width is provided within the communication passage 5. The ink guide member retainers 13 can be molded integrally with the cabinet of the ink tank 1.

To dispose the ink guide member retainers 13, a larger number of the retainers 13 may be placed on the side of the joint port 11 and a smaller number of the retainers 13 may be placed on the side of the intermediate ink chamber 4. Here, one is placed on the side of the intermediate ink chamber 4 and two are placed on the side of the joint port 11 so that the angle between the ink guide member retainer 13 placed on the side of the intermediate ink chamber 4 and the ink guide member retainers 13 placed on the side of the joint port 11 becomes 130° and that the angle between the ink guide member retainers 13 placed on the side of the joint port 11 becomes 100°. Bubbles occurring in the communication hole 7 enter the communication passage 5 through wide spaces between the ink guide member retainers 13. Thus, a smaller number of the ink guide member retainers 13 are disposed on the side of the intermediate ink chamber 4, whereby more bubbles enter the side of the intermediate ink chamber 4 and move to the intermediate ink chamber 4 along the slope of the communication passage 5 described below. In contrast, a larger number of the ink guide member retainers 13 are placed on the side of the joint port 11, whereby the entry of bubbles into the joint port 11 side of the communication passage 5 can be decreased. Thus, ink and bubbles can be well separated by adjusting the placement of the ink guide member retainers 13.

The intermediate ink chamber 4, the main ink chamber 2, and the joint port 11 are made to communicate with each other in order via the communication passage 5. As shown in FIG. 1, the upper wall (i.e., the first upper wall) of the communication passage 5 is slanted so as to gradually raise toward the intermediate ink chamber 4 from the communication hole 7, whereby bubbles occurring in the communication hole 7 can be moved smoothly to the intermediate ink chamber 4. Although the bottom of the communication passage 5 may be level, in the embodiment only the section connecting the intermediate ink chamber 4 and the main ink chamber 2 is formed as a slope to reduce the remaining ink amount as much as possible. The joint port 11 may be made at the lowest part of the communication passage 5.

As described above, the bubbles occurring in the communication hole 7 through the first meniscus formation member 8 move to the intermediate ink chamber 4 along the slant top face of the communication passage 5. The bubble move direction at this time is a direction toward the intermediate ink chamber 4 from the communication hole 7. On the other hand, the move direction of ink supplied to the print head is a direction toward the joint port 11 from the communication hole 7. Since the bubble move direction and the ink move direction are opposite to each other, the ink and bubbles can be reliably separated for lessening the mixing of bubbles into the print head in conjunction with the ink guide member retainers 13.

The intermediate ink chamber 4 is filled with ink in the initial state. Bubbles passing through the first meniscus formation member 8 from the main ink chamber 2 and entering the communication passage 5 are collected. The intermediate ink chamber 4 may be sized to enable collection of bubbles entering on rare occasion by the time the main ink chamber 2 becomes empty of ink; it can be made of a small chamber. To collect bubbles, the top face of the intermediate ink chamber 4 needs to be formed so as to become above the communication hole 7 of the main ink chamber 2.

The amount of bubbles collected in the intermediate ink chamber 4 does not increase much while the capillary member 3 holds ink, but if the ink held in the capillary member 3 runs out and air enters through the first meniscus formation member 8 as bubbles, the amount of collected bubbles increases rapidly. Thus, if the ink held in the capillary member 3 runs out, the liquid level in the intermediate ink chamber 4 lowers rapidly. At least a part of the intermediate ink chamber 4 is formed of a transparent substance and lowering of the ink level is sensed, whereby a condition in which the ink tank 1 becomes almost empty of ink can be detected. Of course, the entire ink tank 1 can also be formed of a transparent or semitransparent substance. Various methods such as a visual inspection method and an optical detection method can be used to detect the ink level. A reference line can also be made for convenience of visual inspection.

The joint port 11 is formed with the second meniscus formation member 10 and the absorption material 12 in order. In a state in which the ink tank 1 is detached and left standing, surface tension of ink formed in minute holes made in the second meniscus formation member 10 prevents ink in the intermediate ink chamber 4 and the communication passage 5 from leaking from the joint port 11. When the ink tank 1 is attached to a recorder, air remaining in the joint port 11 due to pressure at the attaching time is passed through an ink film of the second meniscus formation member 10 and is moved to the intermediate ink chamber 4. Thus, the mixing of bubbles into the print head can be reduced. Further, when the ink tank 1 is attached, the second meniscus formation member 10 prevents vibration and shock applied to the ink tank 1, pressure fluctuation caused by acceleration, and the mixing of bubbles from the nozzles of the print head. A filter using as a base material an SUS mesh or a substance comprising SUS fine wires formed like felt and further compressed and sintered, a metal or resin fiber knitted item, etc., can be used as a material of the second meniscus formation member 10 like the first meniscus formation member 8. The filter particle size of the second meniscus formation member 10 is determined by the interfacial tension with used ink and the wet angle as well as the designed bubble point pressure. Specifically, it can range from 5 mm to 60 mm or so. The bubble point pressure in the second meniscus formation member 10 may be set to such a degree that internal ink does not leak and air does not enter with the ink tank 1 detached.

The absorption material 12 disposed in the joint port 11 prevents ink deposited on the joint port 11 from dropping when the ink tank 11 is detached. A material excellent in ink absorption power is used as the absorption material 12; for example, it can be made of a sponge, a filling material comprising polyester fibers bundled in one direction, or the like. It is desirable that the absorption material 12 is low in flow path resistance.

The joint outer peripheral portion 14 of the joint port 11 is shaped at the tip like a convexity. For example, a donut-shaped elastic member is placed in the connection portion of the print head (not shown) to the joint port 11 corresponding to the portion with which a joint outer peripheral portion 19 of the ink tank 1 comes in contact. The joint outer peripheral portion 14 is pressed against the elastic member, thereby sealing the ink flow path in the connection part for preventing ink leakage in the portion.

Next, the operation in the first embodiment of the ink supply unit of the invention will be discussed. In the initial state, the main ink chamber 2 is filled with ink to the limit of ink that can be held by the capillary force of the capillary member 3. It is desirable as the use start condition that the main ink chamber 2 is filled with ink as much as possible from the viewpoint of ink use efficiency. However, the capillary member 3 requires a reasonable portion filled with no ink to generate negative pressure by the capillary force of the capillary member 3. The intermediate ink chamber 4 is filled with ink. In the description to follow, the initial state of ink pressure in the print head can be set to −20 mm $H_2O$, for example. In the initial state before the ink supply unit is attached, the ink pressure is provided by the capillary force of the capillary member 3 for holding ink. Ink in the intermediate ink chamber 4 and the communication passage 5 also becomes negative pressure, which is held by an ink interface formed in the minute holes of the second meniscus formation member 10. Before use, an airtight seal can be put on the joint port 11 and the atmospheric communication port 6. In this state, the ink tank 1 is packaged. To use the ink tank 1, the airtight seal is peeled off before the ink tank 1 is attached to a recorder.

When the ink tank 1 is attached, some air may remain in the joint port 11. The remaining air pushes the ink interface formed on the second meniscus formation member 10 by pressure at the ink supply unit attachment time and enters the communication passage 5 as bubbles. The bubbles entering the communication passage 5 pass through beside the ink guide member retainer 13 and move along the slant of the top face of the communication passage 5 by the buoyant force of the bubbles themselves and are collected in the intermediate ink chamber 4.

When printing is started after the ink tank 1 is attached, ink is consumed at the print head. Then, air as much as the consumed ink gradually spreads into the capillary member 3 from the atmospheric communication port 6. As the ink held in the capillary member 3 decreases, the water head of ink decreases and negative pressure gradually increases, but hovers within the allowable range. Even if the ink lessens, it can be supplied at stable negative pressure by the capillary force of the capillary member 3. The ink held in the capillary member 3 moves smoothly through the first meniscus formation member 8 to the communication passage 5.

In ink supply at the normal print operation, air entering through the atmospheric communication port 6 attempts to enter the first meniscus formation member 8 along the side wall of the main ink chamber 2, but a very small quantity of air arrives at the surface of the first meniscus formation member 8 because it is pressed into contact with the capillary member 3 on the bottom face of the main ink chamber 2. If slight air arrives at the surface of the first meniscus formation member 8, it remains trapped on the first meniscus formation member 8 and ink continues to move. If bubbles mixed in the ink pass through the capillary member 3 and air comes in contact with the top face of the first meniscus formation member 8, it also remains trapped on the first meniscus formation member 8 and ink continues to move by setting the filter particle size of the first meniscus formation member 8 finer than that of the capillary member 3. The ink movement from the main ink chamber 2 to the intermediate ink chamber 4 is made until the ink held in the capillary member 3 is almost consumed.

As maintenance operation to avoid nozzle clogging, etc., ink may be sucked from the nozzle tips in a state in which bubbles are trapped on the surface of the first meniscus formation member 8. In this case, since the ink is forcibly sucked from the nozzle tips, a larger negative pressure than usual occurs. When a large amount of ink is consumed as in printing all over, negative pressure may become larger than usual. At such time, bubbles trapped on the surface of the first meniscus formation member 8 are pulled into the communication passage 5 together with ink through the minute holes on rare occasion. The bubbles pulled into the communication passage 5 side of the first meniscus formation member 8 grow together with other bubbles, overflow the communication hole 7, and move along the slant top face of the communication passage 5 to the intermediate ink chamber 4 by the buoyant force of the bubbles, then are collected in the upper part of the intermediate ink chamber 4. If the face of the first meniscus formation member 8 on the communication passage 5 side is covered with bubbles, negative pressure is held by the surface tension of the ink interface formed in the minute holes of the first meniscus formation member 8.

When the ink held in the capillary member 3 is almost consumed, air comes in contact with the top of the first meniscus formation member 8. In this state, the minute holes of the first meniscus formation member 8 are formed with ink interface or ink meniscuses. As the ink is furthermore consumed, negative pressure gradually increases. When a given negative value (bubble point pressure of ink determined by the filter particle size of the first meniscus formation member 8) is applied to the first meniscus formation member 8, fine bubbles of air occur on the communication passage 5 side of the first meniscus formation member 8 through the ink interface or ink meniscuses formed on the first meniscus formation member 8. The fine bubbles move along the slope of the communication passage 5 to the inside of the intermediate ink chamber 4 by the buoyant force of the bubbles. At this time, a smaller number of the ink guide member retainers 13 are placed on the side of the intermediate ink chamber 4, whereby more bubbles move to the side of the intermediate ink chamber 4 and further move along the slant of the top face of the communication passage 5, whereby the bubbles are smoothly moved to the intermediate ink chamber 4. The bubbles moved to the intermediate ink chamber 4 remain therein gradually. The subsequent ink dynamic pressure is controlled by the first meniscus formation member 8 and is held almost constant until ink runs out.

After the ink held in the capillary member 3 runs out, both faces of the first meniscus formation member 8 are exposed to air. That is, the main ink chamber 2 side of the first meniscus formation member 8, when the main ink chamber 2 becomes empty of ink, is exposed to air introduced through the atmospheric communication port 6. The communication passage 5 side of the first meniscus formation member 8, where a minute air layer is formed by bubbles entering via the first meniscus formation member 8, is also exposed to air. However, the ink guide member 9 sucks up the ink in the communication passage 5 to the first meniscus formation member 8 for always maintaining the first meniscus formation member 8 in a wet condition. Thus, the first meniscus formation member 8 is continuously formed with an ink film and the negative pressure control operation after bubbles occur is performed effectively. The ink guide member 9, which is pressed by the ink guide member retainers 13, is held in contact with the first meniscus formation member 8. Thus, the pressure is controlled to stabilize ink supply pressure until the ink in the intermediate ink chamber 4 and the communication passage 5 almost runs out.

By the way, if an environmental change such as an external pressure or temperature change occurs, the atmospheric pressure received by the capillary member 3 from the atmospheric communication port 6 is the same as that received by the nozzle tips of the print head 1. Thus, even if the atmospheric pressure changes, the pressure balance is kept and the effect is small. If air is collected in the intermediate ink chamber 4, the collected air expands or shrinks as the external temperature or pressure changes. If the air in the intermediate ink chamber 4 shrinks, negative pressure rises, thus the change is canceled by similar operation to that performed when ink is consumed. If the air in the intermediate ink chamber 4 expands, ink in the intermediate ink chamber 4 and the communication passage 5 is absorbed by the capillary member 3 through the first meniscus formation member 8 and the negative pressure in the communication passage 5 is kept. In either case, however, the intermediate ink chamber 4 contains a small amount of air and the volume of the main ink chamber 2 is far larger than that of the intermediate ink chamber 4, thus no problem arises.

Figure 5:
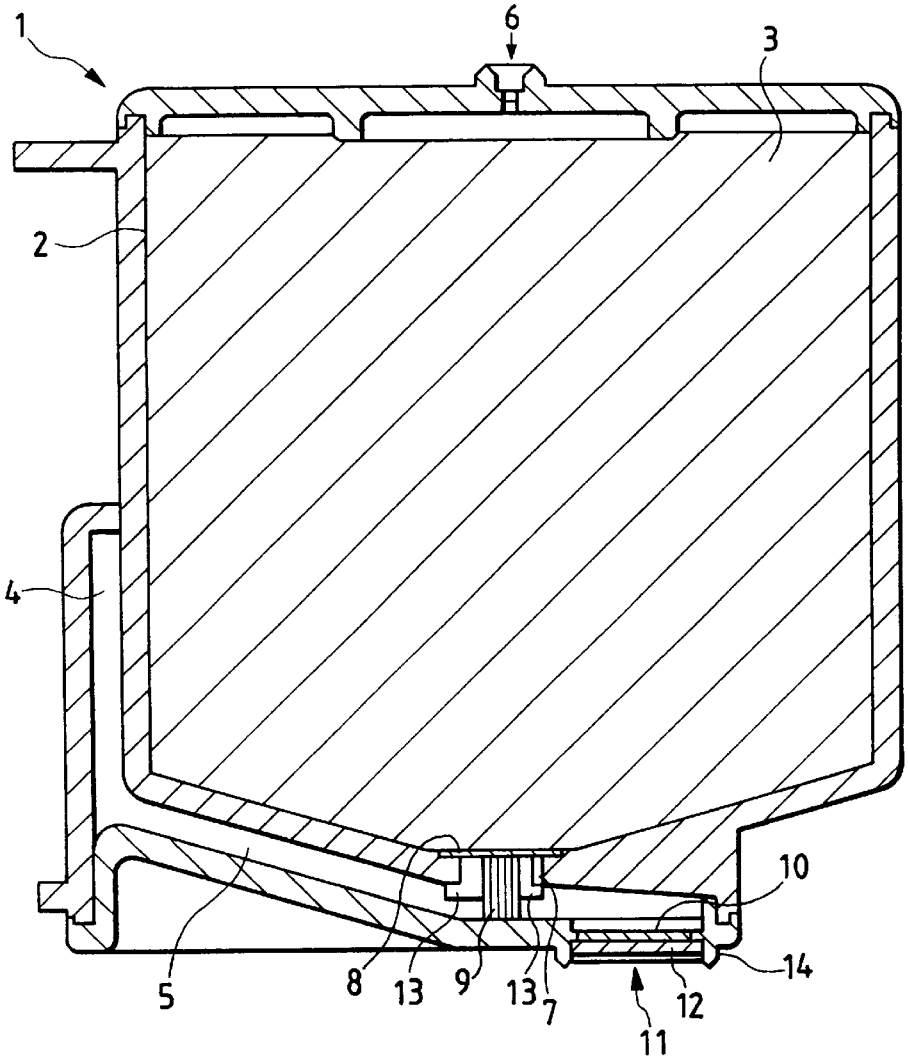
FIG. 5 is a sectional view showing a second embodiment of an ink supply unit of the invention.

FIG. 5 is a sectional view showing a second embodiment of an ink supply unit of the invention. Parts identical with those previously described with reference to FIG. 1 are denoted by the same reference numerals in FIG. 5. In the second embodiment, the top face of the section from a joint port 11 of a communication passage 5 to a first meniscus formation member 8 (i.e., the second upper wall) is also made a slope. That is, the top face of the communication passage 5 is formed so as to gradually rise from the joint port 11 to an intermediate ink chamber 4. For example, when an ink tank 1 is attached to a recorder, as described above, air in the connection part of the ink tank 1 and the recorder enters through the joint port 11 as bubbles. The bubbles entering the communication passage 5 float to the top face of the communication passage 5 by the buoyant force of the bubbles themselves. Since the top face of the communication passage 5 becomes a slope to the intermediate ink chamber 4, the bubbles move along the slope to the intermediate ink chamber 4 and are collected therein. Although ink guide member retainers 13 hang from the top face of the communication passage 5 on the way, the bubbles pass through between the side face of the communication passage 5 and the ink guide member retainer 13 and move to the intermediate ink chamber 4.

Most of the bubbles entering from the main ink chamber 2 are guided to the intermediate ink chamber 4 by the ink guide member retainers 13 as described above, but bubbles also occur on the side of the joint port 11. These bubbles cannot move in the direction of the joint port 11 because the top face of the communication passage 5 descends toward the joint port 11; in contrast, the bubbles move to the intermediate ink chamber 4 through the gap between the ink guide member retainer 13 and the side wall of the communication passage 5.

Thus, according to the second embodiment of the invention, the bubbles entering through the communication hole 7 or the joint port 11 are moved to the intermediate ink chamber 4, so that no bubbles remain in the vicinity of the joint port 11 and the mixing of bubbles into a print head can be prevented.

Figure 6:
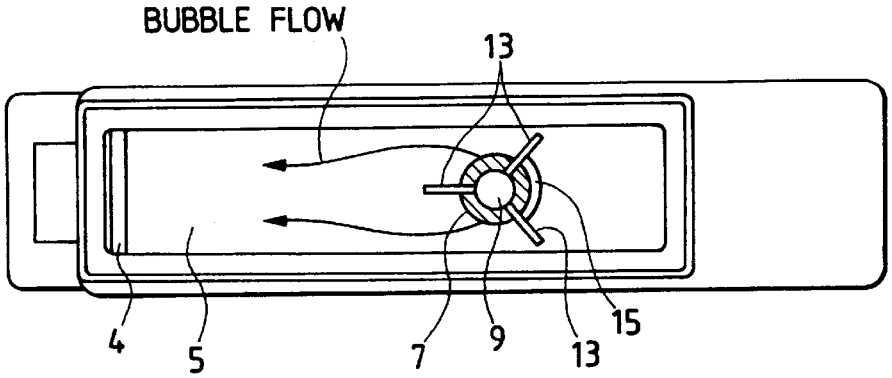
FIG. 6 is a plan view of a communication passage top face showing a modified example in the first and second embodiments of the ink supply unit of the invention.

FIG. 6 is a plan view of a communication passage top face showing a modified example in the first and second embodiments of the ink supply unit of the invention. Parts similar to those previously described with reference to FIG. 1 are denoted by the same reference numerals in FIG. 6 and will not be discussed again. In FIG. 6, numeral 15 is a wall, which hangs from the top face of a communication passage 5 in the surroundings of the joint port 11 side of a communication hole 7. The bottom end of the wall 15 is not in contact with the bottom face of the communication passage 5, providing a gap therebetween used as an ink flow path.

In the first and second embodiments, the bubbles occurring on the bottom face of the first meniscus formation member 8 occur not only on the intermediate ink chamber 4 side, but also on the joint port 11 side. The wall 15 prevents the bubbles occurring on the joint port 11 side from moving toward the joint port 11. In FIG. 6, the wall 15 is placed so as to couple two ink guide member retainers 13 disposed on the joint port 11 side, improving mutual strength. However, the wall 15 is not limited to the form and can also be formed as an independent protrusion. Of course, it may be molded integrally with the cabinet of the ink tank 1. In the first embodiment and the modified example, three ink guide member retainers 13 are placed, but two or four or more retainers can also be placed.

Figure 7:
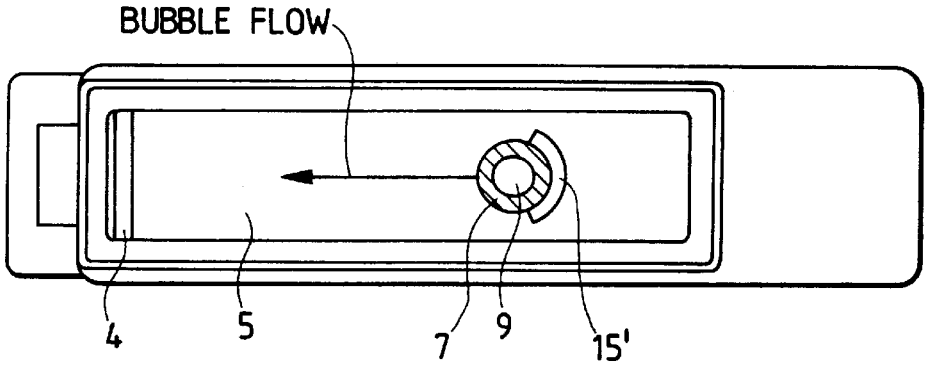
FIG. 7 is a plan view of a communication passage top face showing another modified example in the first and second embodiments of the ink supply unit of the invention.

FIG. 7 is a plan view of a communication passage top face showing another modified example in the first and second embodiments of the ink supply unit of the invention. Parts similar to those previously described with reference to FIG. 6 are denoted by the same reference numerals in FIG. 7. In the first and second embodiments, the ink guide member 9 is inserted between the ink guide member retainers 13 when the ink tank 1 is assembled. However, in addition, for example, the ink guide member 9 can also be attached directly to the first meniscus formation member 8 for use as an assembly of the first meniscus formation member 8 and the ink guide member 9, or the first meniscus formation member 8 and the ink guide member 9 can also be integrally molded of the same material, in which case the ink guide member 9 can be made unnecessary. At this time, as shown in FIG. 7, a structure wherein a wall 15' is hung from the top face of a communication passage 5 in the surroundings of the joint port 11 side of a communication hole 7 can be adopted to guide bubbles overflowing the communication hole 7 to an intermediate ink chamber 4.

Bubbles entering the communication passage 5 from a main ink chamber 2 are suppressed in a move in the direction of the joint port 11 and promoted in a move to the intermediate ink chamber 4. Thus, the mixing of bubbles into a print head through the joint port 11 can be prevented. Since ink toward the joint port 11 moves between the wall 15, 15' and the bottom face of the communication passage 5, the ink flow is not hindered. Further, bubbles entering through the joint port 11 pass through between the wall 15, 15' and the side wall of the communication passage 5 and move to the intermediate ink chamber 4; no bubbles remain in the vicinity of the joint port 11.

Figure 10:
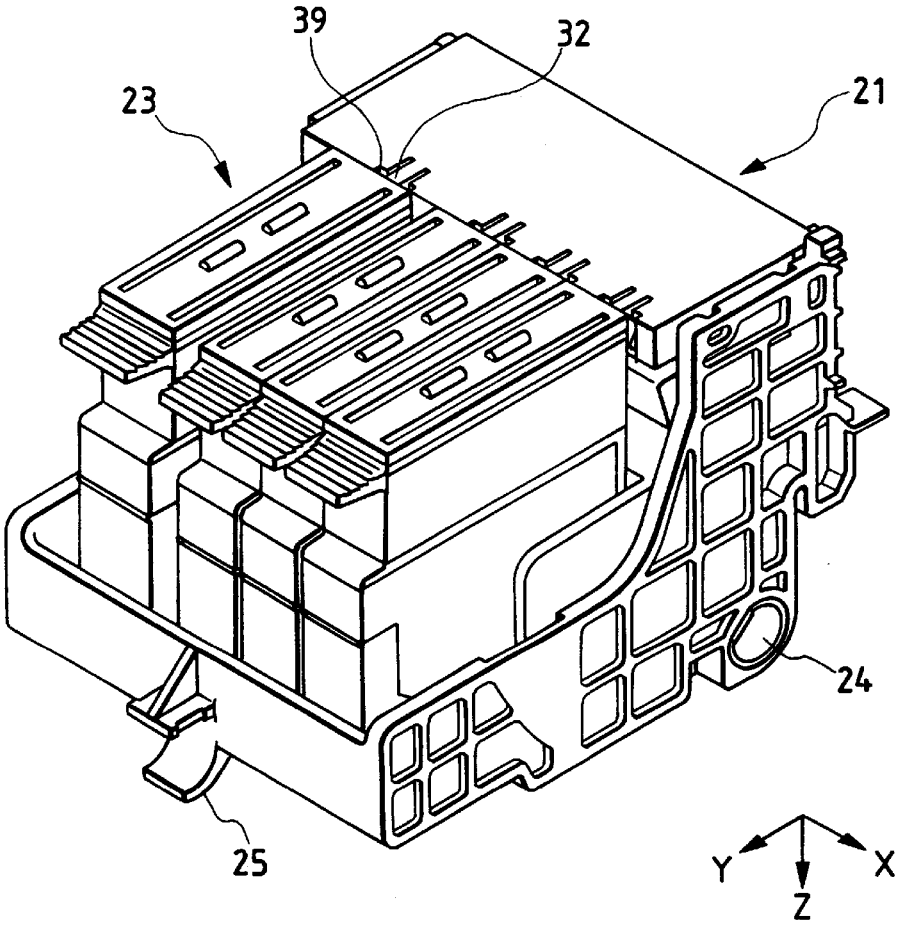
FIG. 10 is a perspective view showing a state of the carriage after the ink supply unit of the invention is attached.
Figure 8:
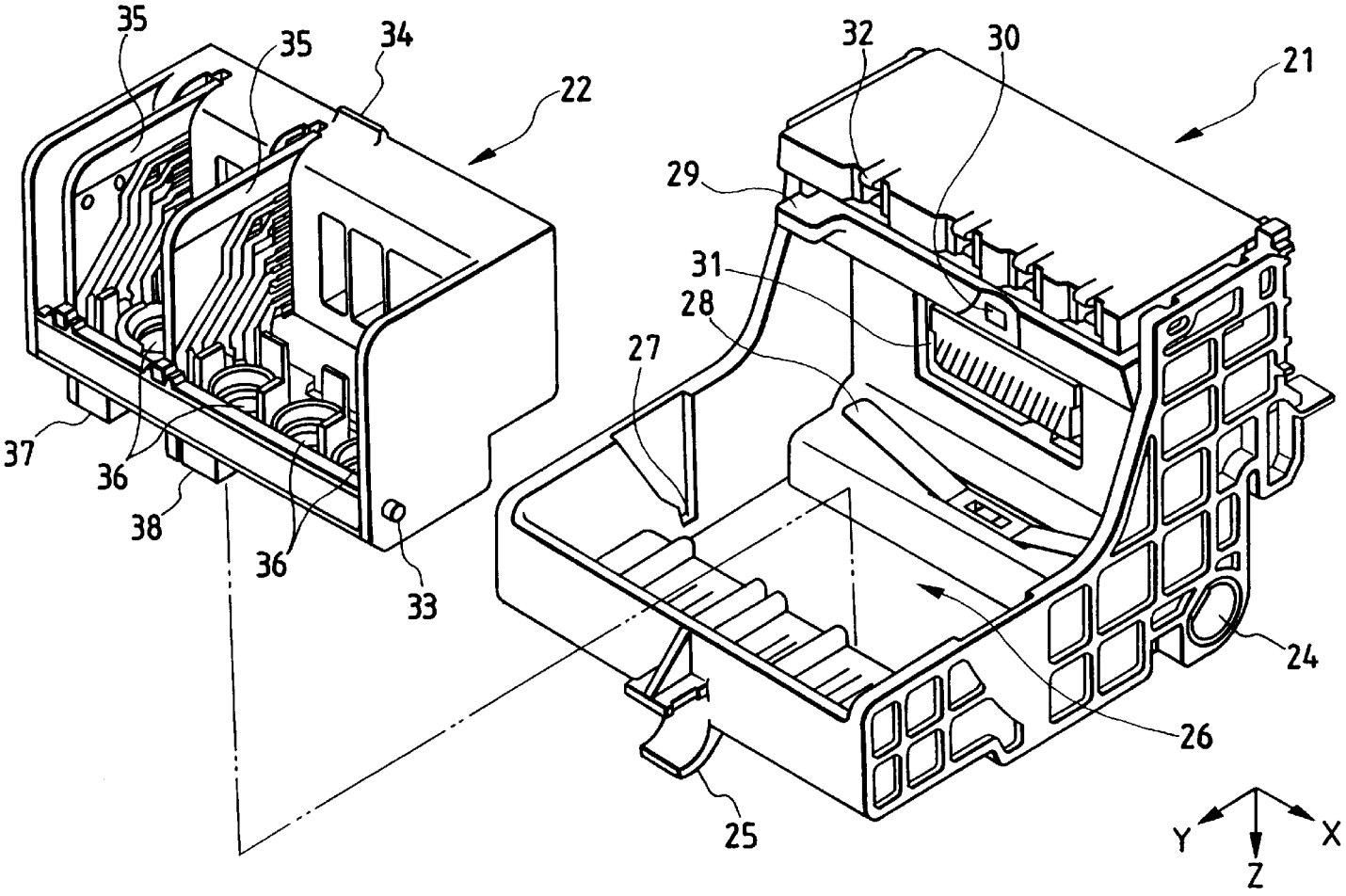
FIG. 8 is a perspective view showing a state before a print head unit is attached in an example of a carriage to which the ink supply unit of the invention is attached.
Figure 9:
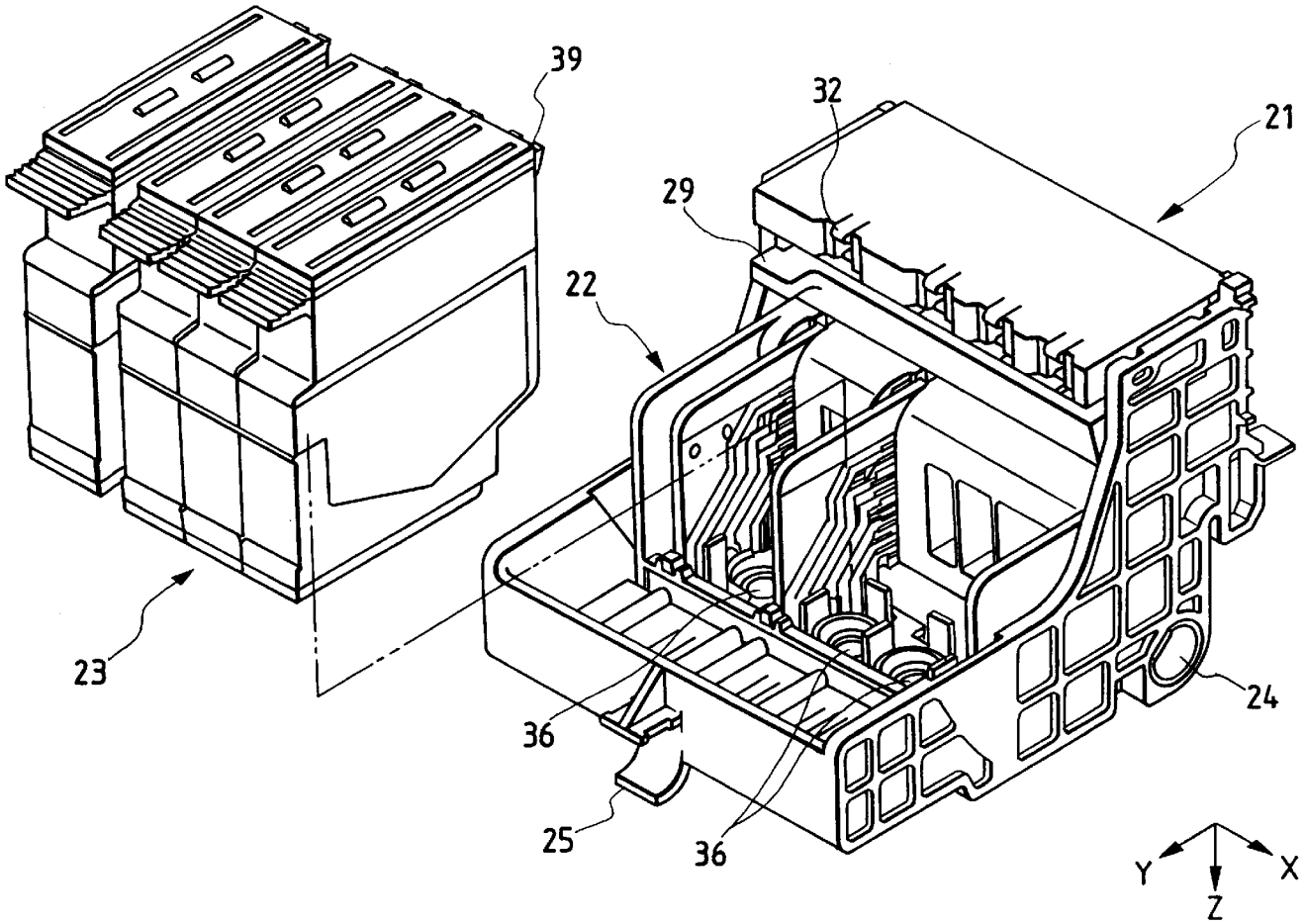
FIG. 9 is a perspective view showing a state before the ink supply unit is attached in the example of the carriage to which the ink supply unit of the invention is attached.
Figure 11:
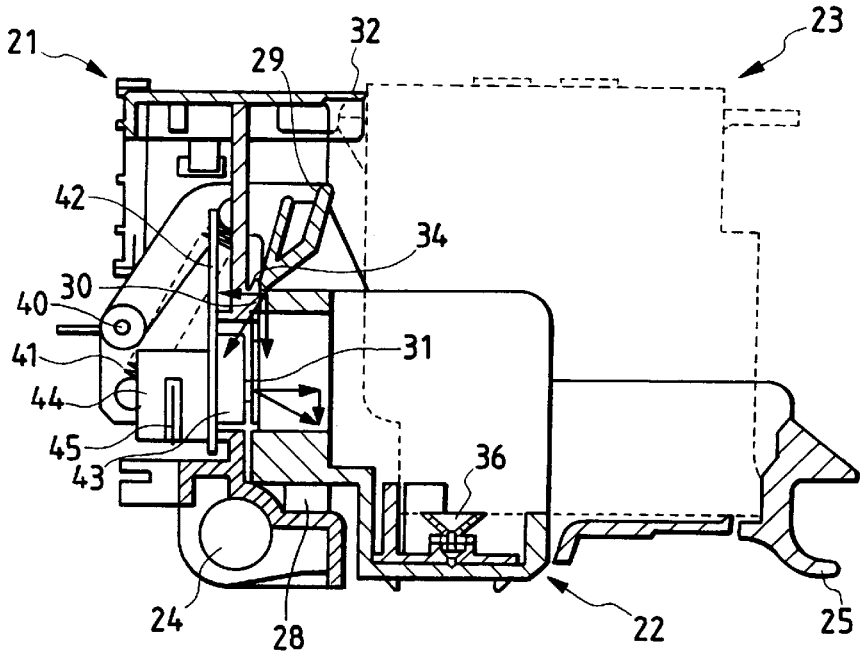
FIG. 11 is a sectional view showing the state of the carriage after the ink supply unit of the invention is attached.

FIGS. 8 to 10 are perspective views showing an example of a carriage to which the ink supply unit of the invention is attached. FIG. 11 is a sectional view. In the figures, numeral 21 is a carriage, numeral 22 is a print head unit, numeral 23 is an ink tank, numeral 24 is a shaft hole, numeral 25 is a guide plate receptacle, numeral 26 is an opening, numeral 27 is a protrusion receptacle, numeral 28 is a plate spring, numeral 29 is a print head retaining lever, numeral 30 is a print head abutment part, numeral 31 is contact pins, numeral 32 is an ink tank retainer, numeral 33 is a protrusion, numeral 34 is a print head fixing part, numeral 35 is boards, numeral 36 is ink guide parts, numeral 37 is a black head, numeral 38 is a color head, numeral 39 is a fit part, numeral 40 is a shaft, numeral 41 is a spring, numeral 42 is a contact board, numeral 43 is a connector, numeral 44 is a position sensor, and numeral 45 is a timing fence.

The carriage 21 is formed with the shaft hole 24 and the guide plate receptacle 25 so as to be movable by a main shaft and a guide plate of the main unit of a recorder. To incorporate the print head unit 22 into the carriage 21, the carriage 21 is formed with the opening 26 at the center, the protrusion receptacles 27 on both side walls, and the plate spring 28 on the rear bottom face. As shown in FIG. 11, the print head retaining lever 29 is fixed on both ends pivotably to the shaft 40 and is energized by the spring 41. When the print head unit 22 is attached to the carriage 21, the print head retaining lever 29 presses the print head unit 22 slantingly against the print head abutment part 30 and energizes it in the Z direction and −Y direction in the figures, as indicated by the heavy arrow in FIG. 11. When the print head unit 22 is attached, the print head abutment part 30 abuts the print head fixing part 34 of the print head unit 22 for positioning the print head unit 22. In FIG. 8, a part of the print head retaining lever 29 is cut away so that the internal print head abutment part 30 can be seen.

As shown in FIG. 11, the contact board 42 is disposed in the rear of the carriage 21 and is electrically connected to the recorder main unit by a flexible cable, etc. The connector 43 is attached to the contact board 42. The contact pins 31 of the connector 43 are provided for electric connection to the print head unit 22 and supplying power and various signals supplied from the recorder main unit to the print head unit 22. The contact board 42 further includes the position sensor 44 for detecting a mark put on the timing fence 45.

The ink tank retainer 32 is fitted in the fit part 39 of the ink tank 23 for locking the ink tank 23. The ink tank 23 is pressed against the ink guide part 36 of the print head unit 22 by the press force of the ink tank retainer 32 for sealing the connection part of the print head unit 22 for liquid communication. A dent as wide as the width of the fit part 39 is made in the proximity of the ink tank retainer 32 and the fit part 39 is inserted into the recess, thereby positioning in the X direction and −Y direction in the figures.

The print head unit 22 is provided with ink guide parts 36 connected liquidly to ink tanks 23 for receiving supplied ink for each color. Here, ink guide parts 36 for receiving black ink and ink of other three colors are disposed. Black ink received at the corresponding ink guide part is supplied to the black head 37 and ink of other colors received at the corresponding ink guide parts is supplied to the color head 38. The black head 37 and the color head 38 comprise a large number of nozzles arranged in the Y direction in the figures. With the black head 37, all arranged nozzles can be used for recording in black. With the color head 38, the arranged nozzles are separated into three groups and the nozzles in each group are used for recording in the corresponding color. Unused nozzles may be provided. On the other hand, the print head unit 22 is provided with the boards 35 on which drive circuits for driving the black head 37 and the color head 38 are mounted. The boards 35 are electrically connected to the contact pins 31 of the carriage 21. Here, two boards are provided corresponding to the heads. The boards can be made of, for example, metal and are also used as heat sinks for heat radiation of the black head 37 and the color head 38. The print head unit 22 is formed with the protrusions 33 on side faces and the print head fixing part 34 on the top for use when the print head unit 22 is attached to the carriage 21. The protrusions 33 are fitted into the protrusion receptacles 27 of the carriage 21 for holding and positioning the print head unit 22. The print head fixing part 34 abuts the print head abutment part 30 of the carriage 21 and is pressed and fixed by the print head retaining lever 29.

To attach the print head unit 22 to the carriage 21, the print head retaining lever 29 is lifted up and pivoted and the print head unit 22 is inserted into the carriage 21 from the top thereof so that the black head 37 and the color head 38 of the print head unit 22 are exposed from the opening 26 of the carriage 21. At this time, it can be inserted slightly slantingly for easy insertion. The protrusions 33 of the print head unit 22 are inserted into the protrusion receptacles 27 of the carriage 21 and abut the deepest parts for positioning the front side of the print head unit 22. Further, the print head fixing part 34 of the print head unit 22 is abutted against the print head abutment part 30 of the carriage 21 and the print head retaining lever 29 is released for pressing the carriage 21 in the Z direction and −Y direction by the energy of the print head retaining lever 29. The force directions at this time are indicated by the heavy arrows in FIG. 11. On the other hand, the print head unit 22 is placed on the plate spring 28 of the carriage 21 and is energized in the −Z direction by the elastic force of the plate spring 28 for fixing the print head unit 22 in conjunction with the print head retaining lever 29.

Further, the contact pins 31 of the carriage 21 are electrically connected to a contact section (not shown) of the print head unit 22. At this time, for stable electric connection, the contact pins 31 require a press force against the contact section of the print head unit 22. The reaction force of each contact pin 31 at this time requires about 80 gf. For example, if 15 signal lines exist, the reaction force of the contact pins 31 requires about 1.2 kgf in total. After the protrusions 33 of the print head unit 22 are inserted into the protrusion receptacles 27 of the carriage 21, the print head unit 22 is fixed by the print head retaining lever 29, whereby the contact section of the print head unit 22 is pressed by a given force by the contact pins 31 for providing stable electric coupling. In FIG. 11, the press force by the contact pins 31 is indicated by the heavy arrow.

Generally, to position and incorporate one part, it is known that the most stable composition is accomplished by positioning at three points on the first reference plane, positioning at two points on the second reference plane, and positioning at one point on the third reference plane. In the example, the print head fixing part 34 of the print head unit 22 and the print head abutment part 30 of the carriage 21 are used for positioning and the protrusions 33 on both sides of the print head unit 22 and the protrusion receptacles 27 on both sides of the carriage 21 are used for positioning with respect to the Y direction by using the press force of the print head retaining lever 29 and the reaction force of the contact pins 31. The print head retaining lever 29 generates a force in a direction forming an angle of about 30° from the Z direction to the −Y direction for pressing the print head unit 22 in the Z direction and −Y direction for securing the abutment between the print head fixing part 34 of the print head unit 22 and the print head abutment part 30 of the carriage 21 for positioning and for pressing the protrusions 33 of the print head unit 22 against the lowest parts of the protrusion receptacles 27 of the carriage 21 for positioning in the Z direction. The protrusions 33 of the print head unit 22 are stably pressed against the protrusion receptacles 27 of the carriage 21 in the Y direction by the reaction force of the contact pins 31 for positioning in the Y direction in the parts. Thus, precise positioning is performed in the Y and Z directions. Positioning in the X direction is performed by the protrusions 33 and the side faces of the carriage 21.

FIG. 9 shows a state in which the print head unit 22 is incorporated in the carriage 21. After the print head unit 22 is incorporated, the ink tanks 23 are attached. Here, a black ink tank and ink tanks of other three colors are attached. The ink tanks shown in the embodiments discussed above can be used as the ink tanks. Each ink tank 23 is formed with the fit part 39. To attach the ink tank 23, it is inserted into a predetermined position with the holding part of the ink tank 23. Then, the fit part 39 of the ink tank 23 is fitted into the ink tank retainer 32 of the carriage 21 and the ink tank 23 is pressurized in the Z direction with respect to the print head unit 22. The joint port made in the bottom face of the ink tank 23 is pressed against the corresponding ink guide part 36 of the print head unit 22 by the pressurization force for defining a sealed ink flow path.

The front lower part of the ink tank 23 abuts the front of the carriage 21 for positioning in the Y direction. The positioning in the Y direction is also performed by means of a wall formed at the depth of the ink guide part 36 of the print head unit 22 and a recess made in the proximity of the ink tank retainer 32 of the carriage 21. Further, positioning in the X direction is performed by means of a partition disposed surrounding the ink guide part 36 of the print head unit 22 and a recess made in the proximity of the ink tank retainer 32 of the carriage 21. In the example, the ink tank 23 is also pressed and fixed by a nail disposed on the face of the carriage 21 facing the bottom face of the ink tank 23. FIG. 10 shows a state in which four ink tanks 23 are attached.

Figure 12:
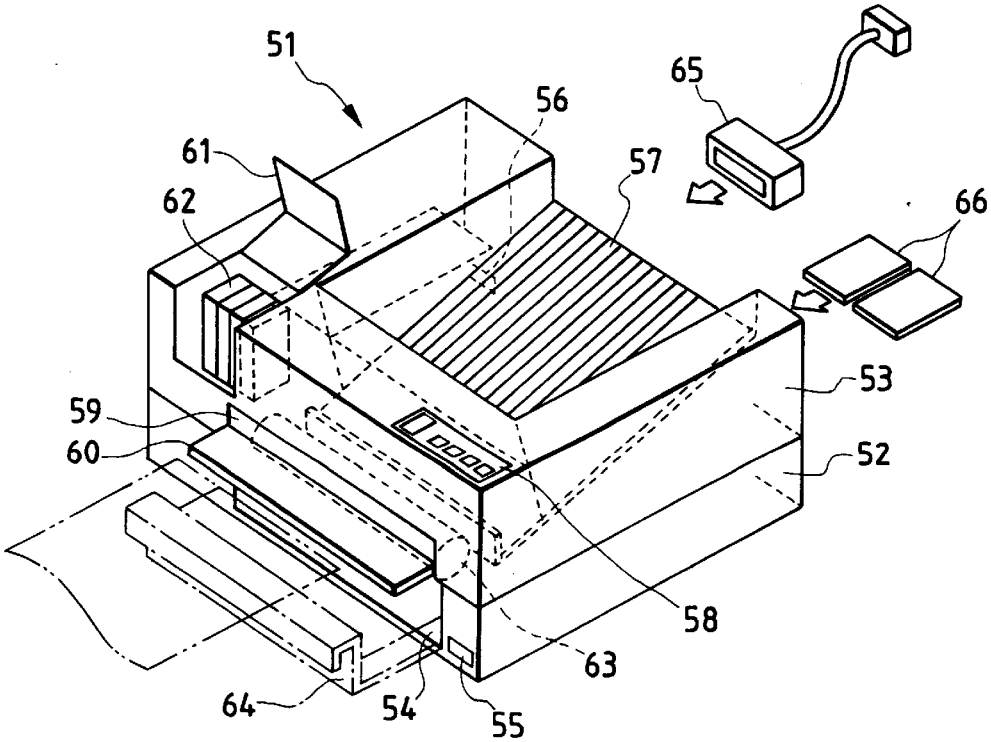
FIG. 12 is an external view showing one example of a recorder.

FIG. 12 is an external view showing an embodiment of a recorder. In the figure, numeral 51 is a recorder, numeral 52 is a lower case, numeral 53 is an upper case, numeral 54 is a tray insertion slot, numeral 55 is a dip switch, numeral 56 is a main switch, numeral 57 is a paper receptacle, numeral 58 is a panel console, numeral 59 is a manual insertion slot, numeral 60 is a manual tray, numeral 61 is an ink tank insertion lid, numeral 62 is an ink tank, numeral 63 is a paper feed roller, numeral 64 is a paper tray, numeral 65 is an interface cable, and numeral 66 is memory cards.

A cabinet of the recorder 51 mainly consists of the upper case 53 and the lower case 52, wherein electric circuitry, drive parts, etc., (not shown) are housed. The lower case 52 is provided with the tray insertion slot 54 through which the paper tray 64 storing record paper is inserted for loading paper into the recorder 51.

The dip switch 55 and the main switch 56 are fitted to the lower case 52. The dip switch 55 is used to set a part of the operation of the recorder 51 and is assigned function settings less frequently changed. When not used, the dip switch 55 is covered with a cover. The main switch 56 is a switch for turning on and off the power of the recorder 51. The lower case 52 is further provided with an interface connector (not shown), insertion slots of the memory cards 66, etc. The interface cable 65 is connected to the interface connector for transferring data to and from an external computer, etc. The memory card 66 is used as an extended memory when the recorder 51 operates; it may store fonts for use at the recording time.

The upper case 53 is formed with the paper receptacle 57 for discharging recorded paper. It is also provided with the panel console 58 comprising input means frequently used for the user to set a record mode and give commands of paper feed, paper discharge, etc., display means of messages from the printer, and the like. Further, the manual insertion slot 59 and the manual tray 60 are provided, enabling the user to manually feed paper.

The upper case 53 is also provided with the ink tank insertion lid 61. The user can attach or detach the internal ink tank 62 by opening the lid. The ink supply units of the invention as shown in the embodiments discussed above can be used for the ink tanks 62. Here, four ink tanks are attached. As shown in FIGS. 8 to 11, the print head unit is fitted to the carriage and further the ink tanks 62 are attached.

Sheets of paper stored on the paper tray 64 are taken out one by one and transported by an internal transport system (not shown) and fed along the circumference of the paper feed roller 63. The record head (not shown) to which the ink tank 62 is attached moves in a direction perpendicular to the paper transport direction for recording data for each strip area. The sheet of paper is fed to the record position of the next strip area in the length direction of the sheet by the paper feed roller 63. This operation is repeated for recording data on the sheet. Then, the sheet is discharged to the paper receptacle 57 of the upper case 53.

In FIGS. 8 to 12, we have discussed the example for using black and other three colors for recording. However, the invention is not limited to the example and three colors except black may be used or five or more ink supply channels may be used. Of course, the invention can also be applied to a monochrome recorder. Further, print heads can also be provided in a one-to-one correspondence with colors in addition to the 2-head composition of the black head 37 and the color head 38 shown in FIGS. 8 to 11.

Figure 13:
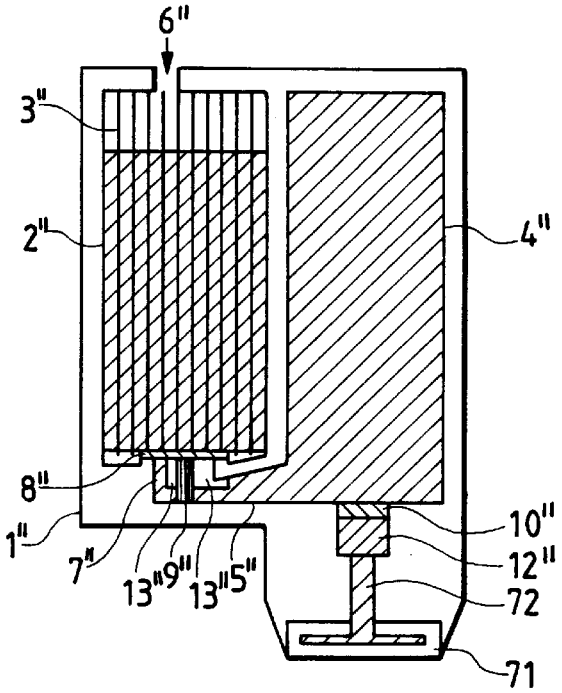
FIG. 13 is a sectional view showing a third embodiment of an ink supply unit of the invention.

FIG. 13 is a sectional view showing a third embodiment of an ink supply unit of the invention. Parts identical with or similar to those previously described with reference to FIG. 1 are denoted by the same reference numerals except primed (for example 1', 2', etc.) in FIG. 13 and will not be discussed again. In FIG. 13, numeral 71 is a print head and numeral 72 is a supply passage. The embodiment shows an example in which the print head 71 and an ink tank 1 are of one-piece construction.

The print head 71 is surrounded by a heat sink (not shown) to which the print head 71 is fitted, a printed wiring board (not shown) for supplying an electric signal to the print head 71, etc. The print head 71 is formed with a large number of nozzles (not shown) at a high density. For example, 128 nozzles can be formed at a density of 300 spi. Each nozzle is provided with a heating element (not shown) for generating bubbles upon energization for jetting ink drops. In FIG. 13, ink drops are jetted downward.

The inside of the ink tank 1' is divided into a main ink chamber 2' and an intermediate ink chamber 4'. The intermediate ink chamber 4' in the embodiment is used as an ink storage chamber rather than an ink chamber for only collecting unnecessary bubbles as in the first and second embodiments. Thus, it can be formed so as to have a size equal to or larger than the main ink chamber 2'. In the first and second embodiments, the ink tank 1 can store only the ink amount almost as much as the ink amount that can be held by the capillary member 3 in the main ink chamber 2. In the third embodiment, however, the intermediate ink chamber 4' can store almost 100% ink, so that the entire volume efficiency of the ink tank 1' can be improved.

In the embodiment, ink is supplied from the intermediate ink chamber 4' via the supply passage 72 to the print head 71. That is, a communication passage 5' only connects a communication hole 7' made in the lower part of the main ink chamber 2' and the intermediate ink chamber 4'. The top face of the communication passage 5' is formed so as to rise gradually from the communication hole 7' to the intermediate ink chamber 4' as in the first and second embodiments, whereby bubbles entering through a first meniscus formation member 8' from the main ink chamber 2' move along the slope of the communication passage 5' to the intermediate ink chamber 4' and are collected on the top of the intermediate ink chamber 4'. In this structure, the bubble move direction is the same as the ink move direction, but the bubbles float to the top of the intermediate ink chamber 4' by the buoyant force of the bubbles before arriving at the supply passage 72. Thus, the bubbles are scarcely mixed into the print head 71.

Further, a plurality of ink guide member retainers 13' are provided for supporting an ink guide member 9' so that a smaller number of the ink guide member retainers 13' are placed on the side of the intermediate ink chamber 4' and that a larger number of the retainers 13' are placed on the opposite side, thereby ensuring connection of the ink guide member 9' and the first meniscus formation member 8' and guiding the bubbles entering from the main ink chamber 2' to the intermediate ink chamber 4'.

A second meniscus formation member 10' is disposed in the connection part of the communication passage 5' and the supply passage 72, but has only a filter function of preventing pressure change by vibration or shock applied to the ink tank 1' or acceleration and the mixing of bubbles from the nozzles of the print head 71, removing dust, etc., because the print head 71 and the ink tank 1' are not separated. Since no ink tanks are attached or detached, an absorption material 12' does not have an ink absorption function and only removes final dust, bubbles, etc. Either or none of the second meniscus formation member 10' and the absorption material 12' can be provided.

The operation of the third embodiment of the ink supply unit of the invention is similar to the operation after the ink tanks are attached in the first or second embodiment. In the third embodiment, a connection part like a joint part does not exist at an intermediate point of the ink flow path from the main ink chamber 2' to the print head 71, so that air or dust is not mixed at attachment or detachment and good recording can be executed. In a state in which the ink supply unit is detached from a recorder, negative pressure is kept on a balance between the capillary force of the nozzles made in the print head 71 and that of a capillary member 3' in the main ink chamber 2' and trouble such as ink leakage does not occur.

Since the intermediate ink chamber 4' has a large volume and a large amount of air is also collected therein in the structure of the third embodiment, if an environmental change such as an external pressure or temperature change occurs, internal air expands or shrinks and the effect cannot be ignored. The operation when such an environmental change occurs will be discussed briefly.

First, when the intermediate ink chamber 4' is filled with ink and ink is supplied from the main ink chamber 2', the atmospheric pressure received by the capillary member 3' from an atmospheric communication port 6' is the same as that received by the nozzle tips of the print head 71. Thus, even if the atmospheric pressure changes, the pressure balance is kept and the effect is small.

Next, an example wherein an air layer is formed in the intermediate ink chamber 4' will be considered. When the external pressure falls or the external temperature rises, the volume of the air layer on the top of the intermediate ink chamber 4' expands and therefore the negative pressure value in the intermediate ink chamber 4' attempts to become relatively small. Thus, ink in the intermediate ink chamber 4' passes through the first meniscus formation member 8' via the communication hole 7' and is absorbed by the capillary member 3' in the main ink chamber 2', whereby the differential pressure between the pressure in the intermediate ink chamber 4' and the atmospheric pressure is kept and ink does not leak.

When the external pressure rises or the external temperature falls, the air layer on the top of the intermediate ink chamber 4' shrinks and therefore the negative pressure value in the intermediate ink chamber 4' attempts to become relatively large. In this case, as with the ink consumption time, air passes through the capillary member 3' from the atmospheric communication port 6' and further passes through the first meniscus formation member 8' and is introduced via the communication hole 7' into the intermediate ink chamber 4', whereby the differential pressure within the intermediate ink chamber 4' is kept constant. When the main ink tank 2' contains ink, a move of ink to the intermediate ink chamber 4' occurs for keeping the negative pressure in the intermediate ink chamber 4'. In either case, ink does not leak.

The third embodiment shows the one-piece construction of the ink supply unit and print head different from the first or second embodiment, but the ink supply unit and print head in the first or second embodiment can also be formed as one-piece construction.

Figure 14:
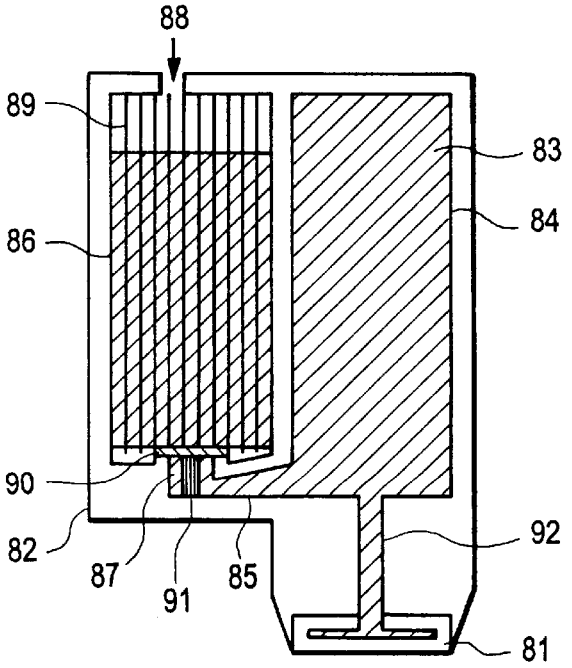
FIG. 14 is a sectional view showing another embodiment of an ink supply device according to the invention.
Figure 15:
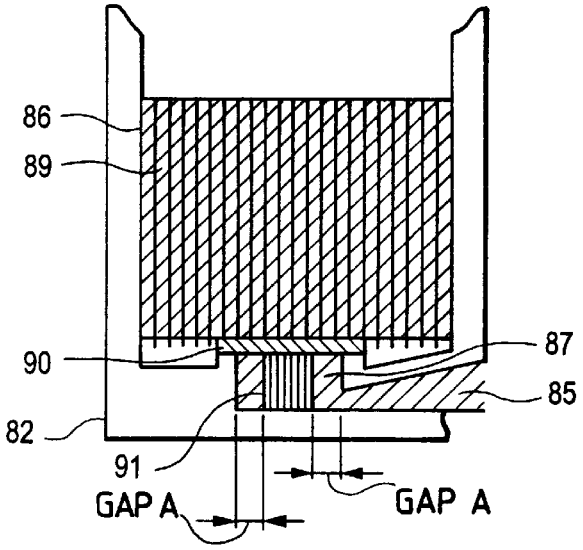
FIG. 15 is an enlarged view showing the lower portion of a sub ink chamber.

FIG. 14 is a sectional view showing an ink supply device according to another embodiment of the invention. FIG. 15 is an enlarged view of the lower portion of a sub ink chamber. In the figures, numeral 81 is an ink jet head, numeral 82 is an ink tank, numeral 83 is ink, numeral 84 is a main ink chamber, numeral 85 is a communication passage, numeral 86 is a sub ink chamber, numeral 87 is a communication hole, numeral 88 is an air communication hole, numeral 89 is an absorption member, numeral 90 is a meniscus forming portion, numeral 91 is an ink leading portion, and numeral 92 is a supply passage. In the embodiment, the ink jet head 81 is integral with the ink tank 82. The ink jet head 81 is surrounded by components such as a heat sink (not shown) to which the head is attached and a printed wiring board (not shown) for supplying electric signals to the ink jet head 81. The ink jet head 81 is formed with a large number of nozzles (not shown) at high density. For example, 128 nozzles can be formed at the density of 300 spi. Each nozzle is provided with a heating element (not shown) for generating bubbles upon energization for jetting ink drops. In FIG. 14, ink drops are jetted downward.

The inside of the ink tank 82 is divided into the main ink chamber 84 and the sub ink chamber 86. To provide rigidity and enable ink storage for a long term, material good in resistance to ink is selected for the housing of the ink tank 82. Only ink is stored in the main ink chamber 84. Ink is supplied from the main ink chamber via the supply passage 92 to the ink jet head 81.

The communication hole 87 is formed on the bottom of the sub ink chamber 86 for communicating with the main ink chamber 84 via the communication passage 85. The section of the communication hole 87 can be formed like a circle, ellipse, polygon, start, cross, slit, or the like. The upper wall of the communication passage 85 may be formed flat; however, as shown in the figures, it is inclined so as to rise gradually toward the main ink chamber 84, whereby bubbles occurring on the communication hole 87 can be moved smoothly to the main ink chamber 84. An absorption member 89 is located in the sub ink chamber 86. Fibrous material having a two-dimensional structure, porous material having a three-dimensional structure, felt provided by spinning fibrous material into a three-dimensional form, or nonwoven fabric can be used as material of the absorption member 89. Specifically, for example, inner cotton material provided by bundling polyester fiber in one direction can be used. Polyester felt at the density (=weight/volume) of 800 g/m$^3$ can be used as the inner cotton material. Polyester felt at the volume density in the range of 5%–15% can be used; it is desirable to use polyester fiber having a value in such a degree from the viewpoints of fluid resistance and capillary attraction. The material is not limited to polyester fiber. For example, a porous member such as polyurethane or melamine form or a one- or two-dimensional fiber structure can be used if the material has moderate capillary attraction and is resistant to ink.

The air communication hole 88 through which the air can be communicated to the absorption member 89 is installed on the top of the sub ink chamber 86. In the embodiment, the diameter of the air communication hole 88 is made larger than a hole of the absorption member 89 or a gap between fibers. The absorption member 89 is communicated with the air on the top and atmospheric pressure release is made. Ink in the absorption member 89 is pressed under atmospheric pressure and is drawn into the main ink chamber side under negative pressure from the bottom of the absorption member 89, so that the ink in the absorption member 89 can be used efficiently. At the time, the negative pressure in the main ink chamber 84 is held constant by capillary attraction of the absorption member 89. The air communication hole 88 can also be formed with a sheet allowing air to be transmitted without transmitting ink for preventing the ink from popping out of the air communication hole 88. Alternatively, the air communication hole 88 can also be provided with a large number of minute holes through which ink does not flow out. The absorption member 89 is inserted into the sub ink tank 86 so that the periphery of the absorption member 89 adheres to the inner wall of the sub ink tank 86 for the purpose of preventing air introduced through the air communication hole 88 from entering along the inner wall of the sub ink tank 86.

The meniscus forming portion 90 is disposed so as to cover the communication hole 87 and come in contact with the bottom of the absorption member 89. For example, it can also be located so as to protrude by several millimeters from the bottom of the absorption member 89, in which case the absorption member 89 is pressed against the meniscus forming portion 90 and the surface of the meniscus forming portion 90 is immersed in the absorption member 89 for providing better fluid junction. The meniscus forming portion 90 can use a mesh substance such as a wire net or resinous net, a porous substance, or the like. Specific examples of available mesh substances include a metal mesh filter, a filter using material provided by forming a metal fiber, such as a thread of SUS, like felt and further compressing and sintering it, and an electroforming metal filter. In addition, a filter of knitted goods of resin fiber and a filter having a very accurate hole diameter provided by laser beam machining, electronic beam machining, etc., can be used. The meniscus forming portion 90 can be thermally welded to the absorption member 89.

When ink is absorbed in the absorption member 89, the ink is moved through the meniscus forming portion 90 to the main ink chamber 84. Even if ink runs out in the absorption member 89, the meniscus forming portion 90 prevents unnecessary air from entering the main ink chamber 89. When ink is further consumed, air coming through the air communication hole 88 passes through the absorption member 89; when negative pressure in the main ink chamber 84 increases, the air presses the liquid face of ink on the meshes of the meniscus forming portion 90 adhering to the absorption member 89, overcomes surface tension, passes through the meniscus forming portion 90, and becomes bubbles. The bubbles move through the communication hole 87 to the main ink chamber 84. The pressure when the bubbles occur (bubble point pressure) depends on the filtration precision of the meniscus forming portion 90. The negative pressure in the main ink chamber 84, namely, the supply pressure of ink to the ink jet head 81 can be held constant by optimizing the filtration precision. A substance having filtration precision of about 70 mm, for example, can be used for the meniscus forming portion 90. The meniscus forming portion 90 also serves a function of removing dust, etc., larger than the filtering precision.

Figure 16A:
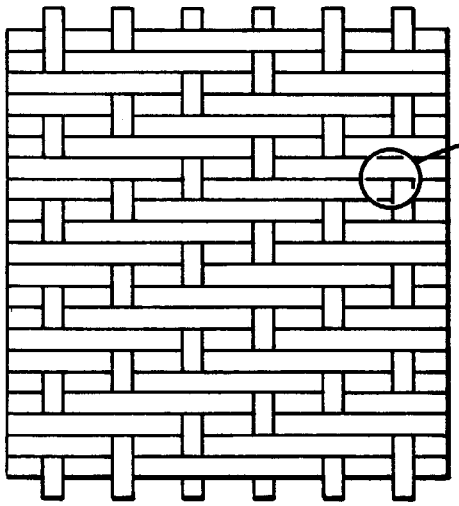
FIGS. 16A to 16C are explanatory diagrams showing one example of mesh substance that can be used for a meniscus forming portion.
Figure 16C:
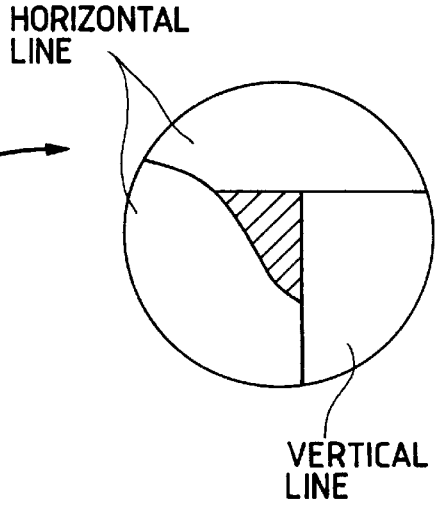
Figure 16B:
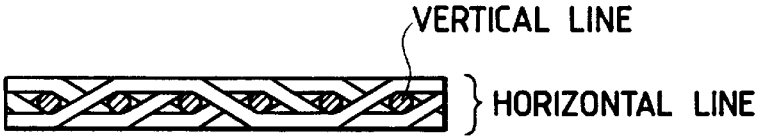

FIGS. 16A to 16C are explanatory diagrams showing one example of mesh substance that can be used for the meniscus forming portion 90. To use a wire net as the meniscus forming portion 90, the wire net can be woven in various manners. FIGS. 16A to 16C show a twilled Dutch weave of a wire net. For the twilled Dutch weave, solid vertical lines are used and horizontal lines come in contact with each other and are woven so as to override every two vertical lines. As in FIG. 16A, when the wire net is viewed from the front, it cannot be seen through because the horizontal lines come in contact with each other. However, when it is viewed slantingly, a triangle aperture is formed by a horizontal line slantingly running from rear to face or from face to rear, a straight horizontal line contiguous to the line, and a vertical line, as shown in FIG. 16C. Ink passes through the triangle aperture and a bubble occurs in the portion. Thus, a wire net of the twilled Dutch weave can be woven with fine and even meshes for generating uniform bubbles. It has features of great mechanical strength and a heavy-duty property as compared with other wire nets having the same filtration precision. Normally, such a wire net is used for filtering; in the invention, in addition to filtering, it also serves a function of adjusting pressure by generating bubbles.

FIG. 17 is an illustration of characteristics of wire nets of twilled Dutch weave. In the figure, the wire net of twilled Dutch weave indicated as A has the filtration grain size of about 10 $\mu$m, fluid resistance average difference of $10.3\times10^4$ g/cm$^4$ s, and pressure loss of about 4.2 cm $H_2O$. The wire net of twilled Dutch weave indicated as B has the filtration grain size of about 5 mm, fluid resistance average difference of $56.1\times10^4$ g/cm$^4$ s, and pressure loss of about 23.1 cm $H_2O$. Thus, the fluid resistance and pressure loss vary depending on coarseness of meshes of the wire net being used. Therefore, a wire net having optimum meshes may be used by considering ink pressure applied to ink, etc.

Referring again to FIGS. 14 and 15, the ink leading portion 91 is in contact with the meniscus forming portion 90 and extends to the lower portion through the communication hole 87. If bubbles are collected on the bottom face of the meniscus forming portion 90 and an air layer is generated or if ink in the main ink chamber 84 decreases and the liquid face of the ink lowers below the diameter of the communication passage 85, both faces of the meniscus forming portion 90 are exposed to air. However, in such a case, the liquid face of ink needs to be formed in the meniscus forming portion 90 because pressure in the main ink chamber 84 needs to be held negative. Thus, the ink leading portion 91 sucks up ink from the bottom of the communication passage 85 and supplies it to the meniscus forming portion 90, thereby holding the meniscus forming portion 90 wet and maintaining negative pressure in the main ink chamber 84. The bottom face of the ink leading portion 91 is extended until it comes in contact with the bottom of the communication hole 87, namely, the bottom of the communication passage 85, whereby the best condition can be maintained until ink is used up. The ink leading portion 91 uses material capable of putting ink up on the meniscus forming portion 90 by capillary attraction; for example, inner cotton material provided by bundling polyester fiber in one direction, a porous member such as polyurethane or melamine form, or a two- or three-dimensional fiber structure can be used. It may take any form, such as a slit form, a rectangular parallelepiped, a prism such as a triangle pole, a cylinder, or an elliptic cylinder. As shown in FIG. 15, the sectional dimension of the ink leading portion 91 is made smaller than the opening dimension of the meniscus forming portion 90, thereby providing gaps A around the ink leading portion 91, whereby bubbles occurring in the meniscus forming portion 90 can be easily moved to the main ink chamber 84. Preferably, the gap A is 0.5 mm or more in width. The ink leading portion 91 can also be attached directly to the meniscus forming portion 90 or be fixed with a rib from the side wall of the communication hole 87.

Figure 26:
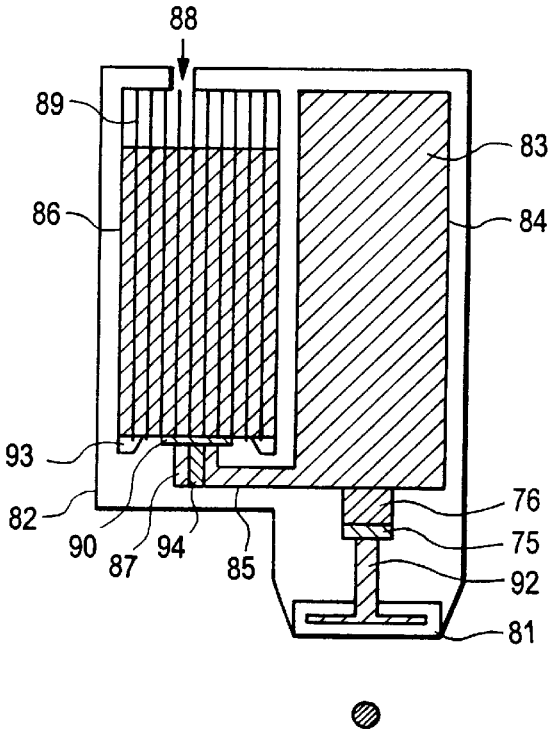
FIG. 26 is a sectional view showing a modified embodiment of an ink supply device according to the invention.
Figure 27A:
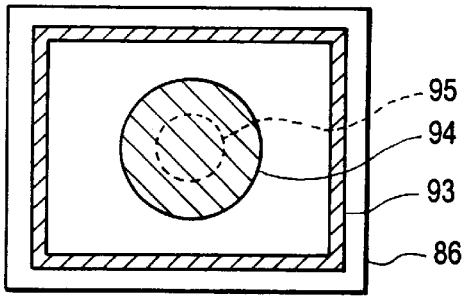
FIGS. 27A and 27B are top views showing a recess used in the ink supply device of FIG. 26.
Figure 28A:
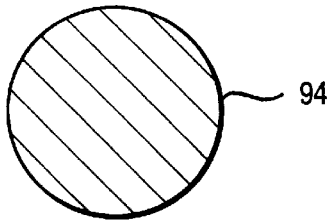
FIGS. 28A and 28B are a top view and a side view showing an ink core member used in the ink supply device of FIG. 26, respectively.
Figure 27B:
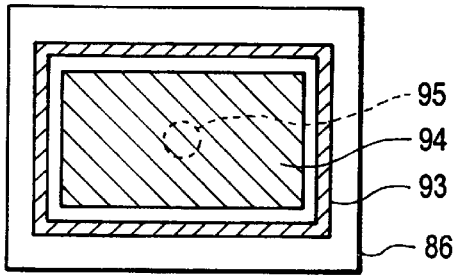
Figure 28B:
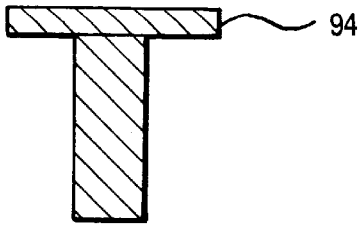

A recess 93 may be formed on the periphery of the bottom face of the sub ink chamber 86, as shown in FIG. 26. FIGS. 27A and 27B show top views of the recess 93. If fibrous material, a porous substance or the like is used as the absorption member 89 housed in the sub ink chamber 86, fluff on the periphery enters the recess 93. When the amount of ink in the sub ink chamber 86 decreases, air easily enters along the inner wall of the sub ink chamber 86. The part of the absorption member 89 entering the recess 93 becomes dense so that air entering from the periphery of the absorption member 89 is introduced into the recess 93 and trapped and can be blocked here. The size of the recess 93 can be designed appropriately depending on the bottom area of the sub ink chamber 86 and the size of the meniscus forming portion 90; for example, it can be made 1.5 mm or less in width and 4 mm or less in depth. An ink core member 94 may be formed integrally with a filter 95 in the form shown in FIGS. 28A and 28B. In this case, for example, inner cotton material provided by bundling polyester fiber in one direction, a porous member such as polyurethane or melamine form, or a two- or three-dimensional fiber structure can be used as the ink core member 94. Specifically, "Sunfine" manufactured by Asahi Kasei, etc., can be used, for example. The ink core member 94 has the filtration grain degree coarser than a filter 95. FIG. 28A is a top view of the ink core member 95 and FIG. 28B is a side view thereof. The top of the ink core member 94 has a size blocking the communication hole 87. The bottom face of the ink core member 94 has a length extending to the communication passage 85. Preferably, it can be made the length extending to the bottom face of the communication passage 85. The ink core member 94 enables the number of parts to be reduced and an ink supply device to be manufactured in a fewer number of steps at low costs. The form of the ink core member 94 is not limited to the form of overlapping cylinders as shown in FIG. 27A; it can be made a different form. For example, the ink core member 94 can be formed fitting the form of the communication hole 87.

The volume efficiency of the ink supply device is described. In the embodiment, the capacity ratio of the main ink chamber 84 to the sub ink chamber 86 is set to 1:1 and the main ink chamber 84 is filled up with ink in the initial state of the ink tank 82. On the other hand, the sub ink chamber 86 is filled with ink in an amount with which the absorption member 89 can be impregnated. For example, inner cotton material provided by bundling polyester fiber in one direction can be used as material of the ink absorption member 89. When the inner cotton material is used, the ink storage efficiency (=ink fill amount/entire ink chamber capacity) is about 80%. The ink use efficiency of the sub ink chamber 86 (=amount of ink that can be supplied/ink fill amount) is about 70%. On the other hand, the ink storage efficiency in the main ink chamber 84 (=ink fill amount/ink absorption member volume) is about 100% and the ink use efficiency (=amount of ink that can be supplied/ink fill amount) is also about 100%. Therefore, the volume efficiency of the ink tank 82 (=amount of ink that can be supplied/entire ink chamber capacity) becomes about 78%. Thus, the ink supply device of the invention is very good in use efficiency of ink.

The volume ratio of the main ink chamber to the sub ink chamber need not necessarily be 1:1 as described above. The size may be determined based on the factors such as the ink amount. As described below, ink in an amount necessary to hold the negative pressure in the main ink chamber 84 if an air layer formed in the upper portion of the main ink chamber 84 expands when temperature rises or atmospheric pressure lowers is stored in the absorption member 89 in the sub ink chamber 86. The amount of ink stored at the time needs to be considered to set the volume of the absorption member 89.

In addition to the form of dividing the ink tank into two chambers as shown in FIG. 14, the positional relationship between the main and sub ink chambers may be a form of surrounding two or three sides of the sub ink chamber by the main ink chamber or a structure in which the sub ink chamber is located like an island in the main ink chamber. In the form or structure, if all or some of the sides of the ink tank are made of transparent substance, the liquid face in the main ink chamber can be checked in any direction by a method such as visual inspection or an optical sensor.

The operation of the ink supply device of the invention is described. The state shown in FIG. 14 indicates that the ink tank 82 is filled with ink. In the state, the ink tank 82 is filled with ink at about 80% of the inner capacity of the absorption member 89 and 100% of the inner capacity of the main ink chamber 84. The ink pressure at the ink jet head 81 can be set to −20 mm $H_2O$, for example. The ink pressure is provided by capillary attraction of the absorption member 89 for holding ink. Although it is desirable to fill up the ink tank 82 with ink as much as possible from the viewpoint of ink use efficiency in the initial state, the absorption member 89 needs to contain some portion not filled with ink in order to generate negative pressure by the capillary attraction of the absorption member 89. Before use, a seal can be put on the nozzle section of the ink jet head 81 and the air communication hole 88. In the condition, the ink supply device is packed.

When printing starts, ink is consumed at the ink jet head 81 and ink in an amount as much as the consumed ink amount is supplied from the main ink chamber 84 via the supply passage 92 to the ink jet head 81. While the absorption member 89 holds ink, ink in the absorption member 89 moves via the communication passage 85 to the main ink chamber 84 and air diffuses gradually into the absorption member 89 through the air communication hole 88.

Figure 18A:
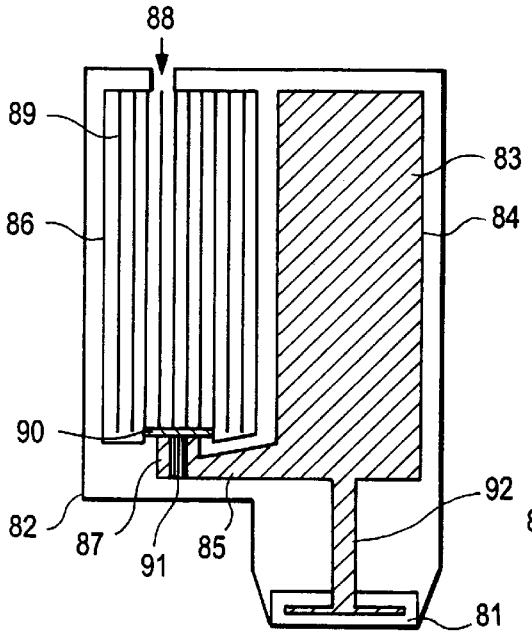
FIGS. 18A to 18C are explanatory diagrams showing an ink consumption process.
Figure 18B:
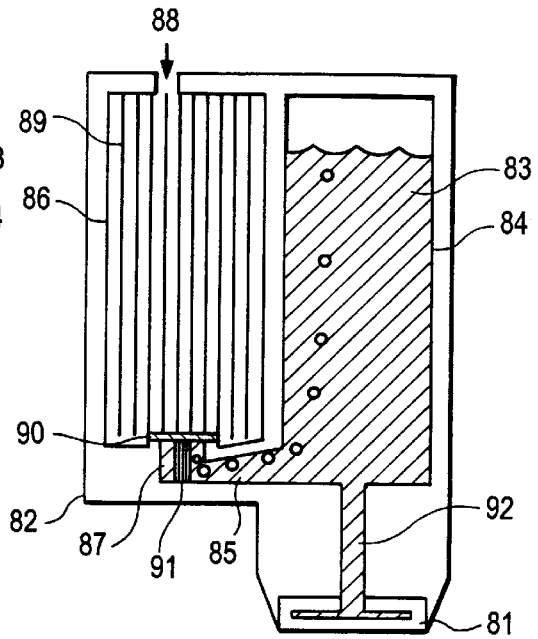
Figure 18C:
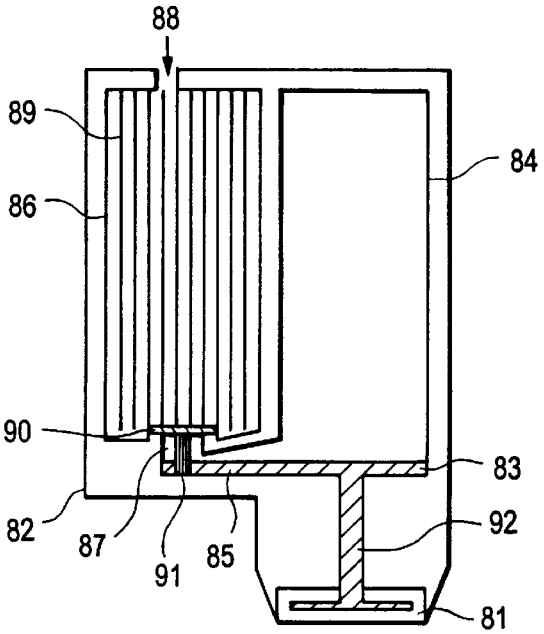

FIGS. 18A to 18C are explanatory diagrams showing process of ink consumption. FIG. 18A shows a state in which air arrives at the meniscus forming portion 90 as ink is consumed. The meniscus forming portion 90 prevents air from entering the main ink chamber 84 until the state is entered. Thus, the remaining amount of ink in the absorption member 89 can be lessened. At the point in time, a meniscus where ink and air come in contact with each other is formed on the meniscus forming portion 90. Although air comes in contact with the top face of the meniscus forming portion 90, a move of ink continues with the air trapped on the meniscus forming portion 90 because the meniscus forming portion 90 has finer filtration precision than the absorption member 89.

As ink is further consumed, the ink water head decreases, increasing negative pressure gradually. When a given negative pressure value (bubble point pressure of filer and ink determined by the filtration precision of the meniscus forming portion 90) is applied to the meniscus forming portion 90, air becomes small bubbles through the ink meniscus formed on the meniscus forming portion 90. These small bubbles are combined with contiguous small bubbles and subsequent bubbles to form large bubbles, which then move through the communication passage 85 to the inside of the main ink chamber 84. At the time, since the upper wall of the communication passage 85 is formed diagonally toward the main ink chamber 84, the bubbles move smoothly on the communication passage 85 to the main ink chamber 84.

When ink is absorbed in the absorption member 89, the ink is moved through the meniscus forming portion 90 to the main ink chamber 84. Even if ink runs out in the absorption member 89, the meniscus forming portion 90 prevents unnecessary air from entering the main ink chamber 84. When ink is further consumed, air coming through the air communication hole 88 passes through the absorption member 89; when negative pressure in the main ink chamber 84 increases, the air presses the liquid face of ink on the meshes of the meniscus forming portion 90 adhering to the absorption member 89, overcomes surface tension, passes through the meniscus forming portion 90, and becomes bubbles. The bubbles move through the communication hole 87 to the main ink chamber 84. The pressure when the bubbles occur (bubble point pressure) depends on the filtration precision of the meniscus forming portion 90. The subsequent supply pressure of ink to the ink jet head 81 can be held constant by optimizing the filtration precision. The bubbles moving to the main ink chamber 84 are collected in the upper portion of the main ink chamber 84, as shown in FIG. 18B.

Figure 19A:
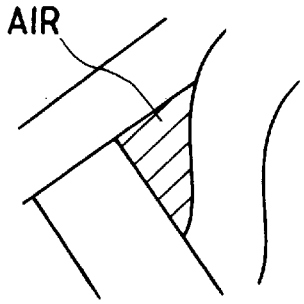
FIGS. 19A to 19D are explanatory diagrams showing a bubble generation process on a wire net of twilled Dutch weave.
Figure 19B:
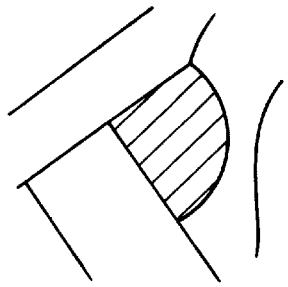
Figure 19C:
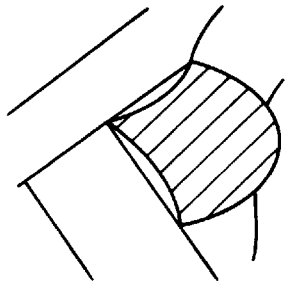
Figure 19D:
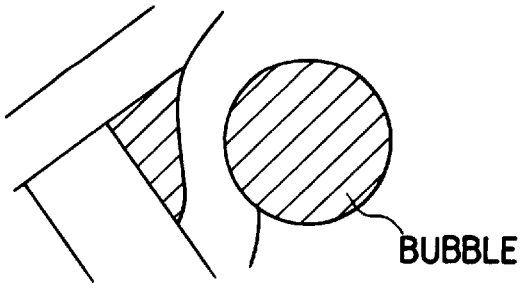

The bubble generation process in the meniscus forming portion 90 at the time is described. FIGS. 19A to 19D are explanatory diagrams showing the bubble generation process on a wire net of twilled Dutch weave. Use of the wire net of twilled Dutch weave shown in FIGS. 16A to 16C as the meniscus forming portion 90 is taken as an example for the description of the bubble generation process. As shown in FIG. 16C, the wire net of twilled Dutch weave has triangle apertures. If the aperture part is wet with ink, an ink film is formed by surface tension of ink. While a pressure balance is kept between both faces of the wire net, the ink film is flat, as shown in FIG. 19A. In FIGS. 19A to 19D, when the pressure on the surface of the wire net lowers, the pressure difference between both the faces causes air on the rear of the wire net to press the ink film for forming a convexity as shown in FIG. 19B. Further, when the pressure on the surface of the wire net lowers, the convexity fills out as shown in FIG. 19C. At last, it becomes a bubble and is separated in ink, as shown in FIG. 19D. At the point in time, the pressure in the ink rises as much as the volume of the bubble, negating the drop in the pressure on the surface of the wire net. Thus, the ink film becomes flat. The bubble separated in the ink is combined with bubbles likewise generated from near meshes to form a large bubble, which then moves to the main ink chamber 84.

Referring again to FIGS. 18A to 18C, when the ink is further consumed, the liquid face of the ink does not fill the communication passage 85, as shown in FIG. 18C. In this state, both faces of the meniscus forming portion 90 are exposed to air. However, since the ink leading portion 91 is immersed in the ink, a capillary phenomenon of the ink leading portion 91 causes the ink to be moved up to the meniscus forming portion 90 for holding the meniscus forming portion 90 wet. Thus, formation of an ink film is continued in the meniscus forming portion 90 and the pressure holding operation in the main ink chamber 84 by generating bubbles functions effectively. From the condition, the supply pressure of ink to the ink jet head 81 is held constant to complete consumption of the ink in the main ink chamber 84. Therefore, a very efficient ink supply device can be provided.

Thus, the meniscus forming portion 90 is always immersed in ink, so that the negative pressure in the main ink chamber 84 is held substantially constant without destroying the ink meniscus formed on the meniscus forming portion 90 until the ink runs out after bubble generation starts.

Figure 20:
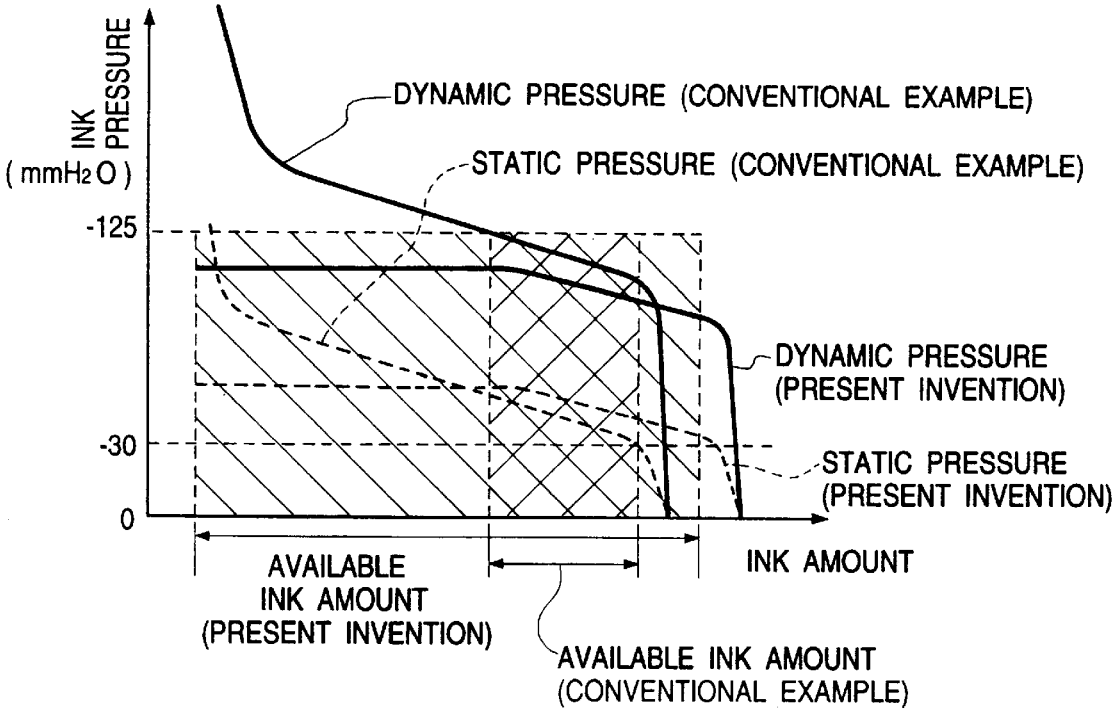
FIG. 20 is an explanatory diagram showing the relationship of ink pressure at ink jet heads to an ink amount.

FIG. 20 is an illustration of the relation of ink pressure at ink jet heads to an ink amount. A change in ink pressure at the ink jet head will affect the jet characteristics of ink from nozzles. In FIG. 20, changes in ink static pressure and ink dynamic pressure at the ink jet head in relation to ink amounts measured using the ink supply device according to the embodiment of the invention shown in FIG. 14 are indicated by a thick line and a thick dotted line. The ink static pressure is the pressure when printing is not performed. The pressure is generated by pressure generated by capillary attraction of the absorption member 89 or the meniscus forming portion 90 and the water head from the liquid face of ink. The ink dynamic pressure can be thought of as the sum of an ink flow quantity, a pressure loss generated by fluid resistance of flow passage, and ink static pressure. In FIG. 20, the ink dynamic pressure is measured when contact printing is performed.

Similar measurement was made using an ink tank of the same size as the ink supply device according to the embodiment of the invention with a conventional ink absorber loaded into the entire inner capacity of the ink tank. Changes in the ink static pressure and ink dynamic pressure in relation to an ink amount at the time are indicated by a thin line and a thin dotted line in FIG. 20 for comparison.

Referring to FIG. 20, both do not greatly differ in pressure loss generated by fluid resistance of the flow passage, namely, difference between the solid and broken lines, but differ fairly in ink static pressure. First, the embodiment of the invention has a larger initial fill amount of ink because its ink tank can be filled with a larger amount of ink.

With the conventional ink tank, the ink static pressure rises in rough proportion to a decrease in the remaining amount of ink because the water head of ink from the head face decreases. In the embodiment of the invention, a rise in the ink static pressure on a similar inclination is observed at the beginning; however, when ink is consumed from the absorption member and bubbles are generated from the meniscus forming portion, the ink static pressure becomes constant. It is considered that the ink pressure is represented as the following expression:

$$Phead=Pair-4g\cos q/D+r\times g\times h2$$

where Phead is pressure at the ink jet head, Pair is atmospheric pressure, g is the interfacial tension between the ink and the meniscus forming portion, q is wet angle, D is the gap diameter in the meniscus forming portion, r is the ink density, g is gravity acceleration, and h2 is the height from the ink liquid face of the meniscus forming portion to the ink jet head. The first and second terms of the expression are determined by the atmospheric pressure and the meniscus forming portion. The water head of ink from the head face on the third term also becomes a constant value because the height h2 becomes constant. Thus, the ink static pressure becomes constant. As a result, the ink dynamic pressure, the sum of an ink flow quantity, a pressure loss generated by fluid resistance of flow passage, and ink static pressure, also becomes constant, providing an efficient ink supply device having a large available ink amount.

It is found in the example that when the negative pressure value at the ink jet head exceeds 125 mm $H_2O$, refilling with ink is hindered, causing the ink drop amount spouted from the nozzles to decrease, causing degradation in print quality, called blur. Thus, in the embodiment of the invention, the ink pressure is held in a proper range in response to a change in the remaining amount of ink, enabling good printing until ink is consumed up.

By the way, the environment will change, for example, outer atmospheric pressure or outer temperature will change. When the main ink chamber 84 is filled up with ink and ink is supplied from the sub ink chamber 86, the atmospheric pressure that the absorption member 89 receives through the air communication hole 88 is the same as the atmospheric pressure that the nozzle tips of the ink jet head 81 receive. Thus, if the atmospheric pressure changes, pressure balance is kept.

Figure 21A:
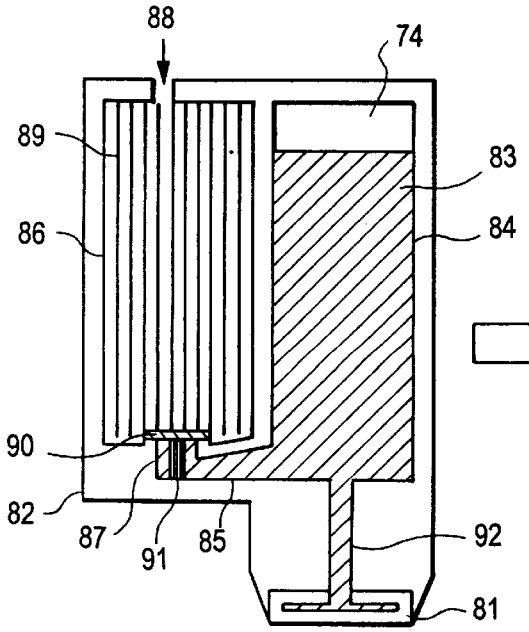
FIGS. 21A and 21B are explanatory diagrams showing a state in a ink tank when environment changes.
Figure 21B:
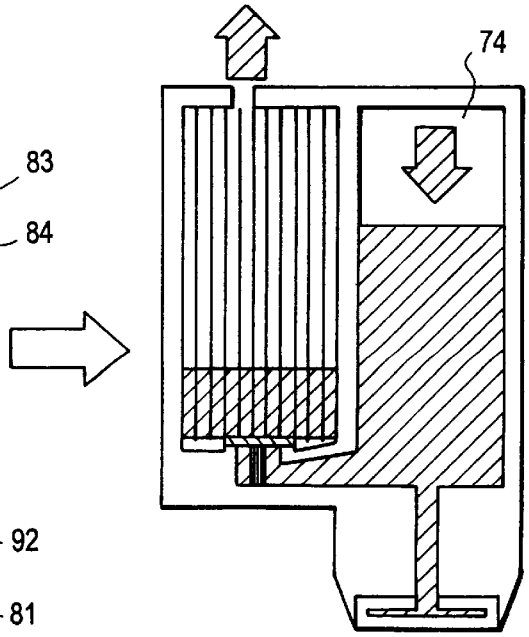

Next, an example in which an air layer is formed in the main ink chamber 84 is discussed. FIGS. 21A, 21B, 22A and 22B are illustrations of the state in the ink tank when the environment changes. In the figures, numeral 74 is an air layer. When the outer atmospheric pressure falls or the outer temperature rises, the volume of the air layer 74 in the upper portion of the main ink chamber 84 expands, thus the negative pressure value in the main ink chamber 84 attempts to become relatively small. For this reason, as shown in FIGS. 21A and 21B, the ink in the main ink chamber 84 passes through the meniscus forming portion 90 via the communication hole 87, and is absorbed in the absorption member 89 in the sub ink chamber 86, thereby holding the differential pressure between the pressure in the main ink chamber 84 and the atmospheric pressure constant and preventing the ink from being leaked.

Figure 22A:
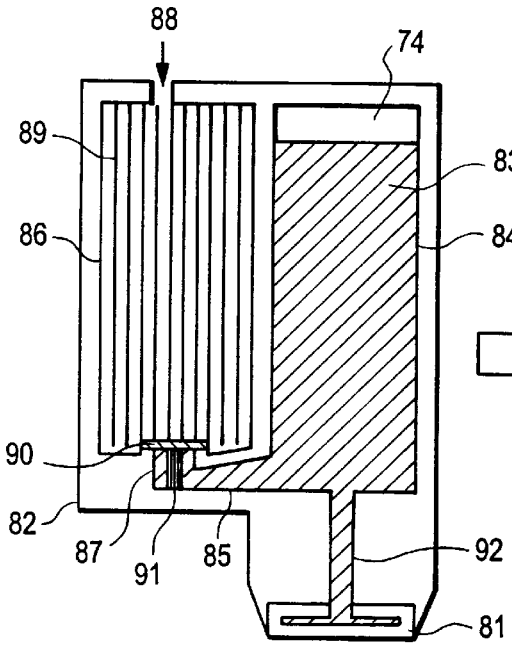
FIGS. 22A and 22B are explanatory diagrams showing a state in the ink tank when the environment changes in a different way.
Figure 22B:
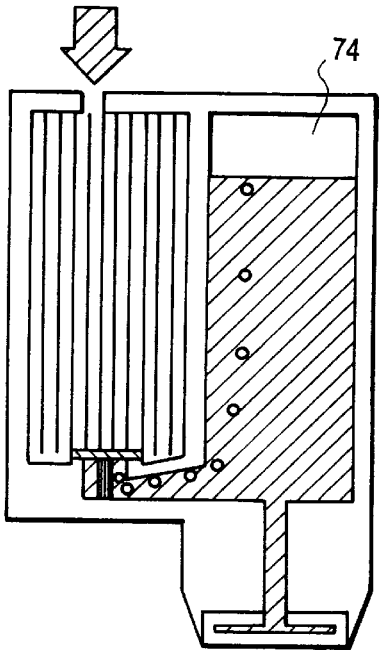

When the outer atmospheric pressure rises or the outer temperature falls, the volume of the air layer 74 in the upper portion of the main ink chamber 84 shrinks, thus the negative pressure value in the main ink chamber 84 attempts to become relatively large. In this case, as shown in FIGS. 22A and 22B, as ink is consumed, air passes through the absorption member 89 via the air communication hole 88 and further passes through the meniscus forming portion 90 and is led into the main ink chamber 84 via the communication hole 87, thereby holding the differential pressure inside the main ink chamber 84 constant. When ink exists in the sub ink chamber 86, the ink moves to the main ink chamber 84 for holding the negative pressure in the main ink chamber 84. In either case, ink leakage does not occur.

Figure 23:
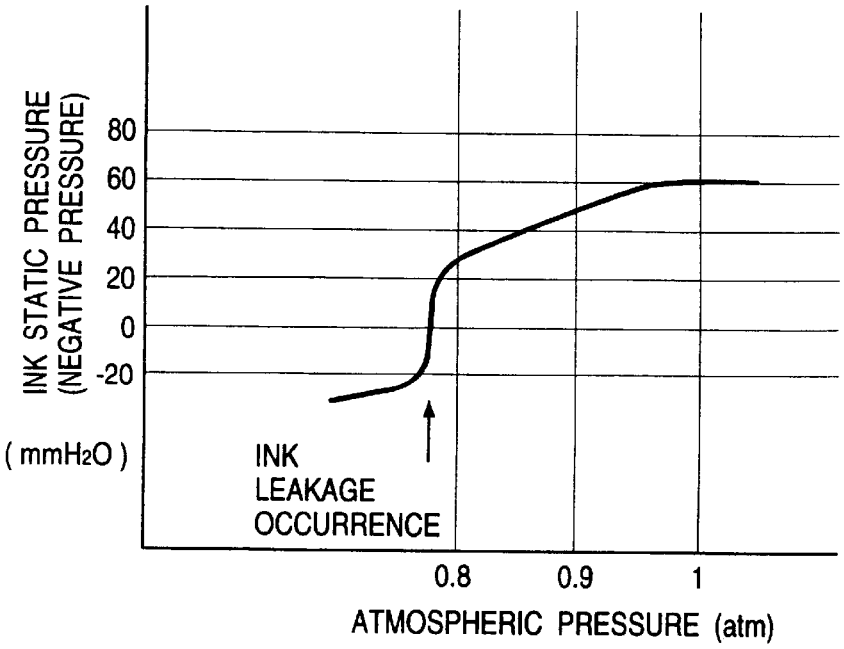
FIG. 23 is an explanatory diagram showing the relationship between atmospheric pressure and ink static pressure.

FIG. 23 is an illustration of the relationship between atmospheric pressure and ink static pressure. The ink supply device shown in FIG. 14 was installed in a pressure reducing chamber and the ambient pressure was reduced gradually at the change rate of 0.02 atmospheres/hour. FIG. 23 shows change in ink negative pressure value occurring at the ink jet head 81 at the time provided the remaining amount of ink in the ink tank 82 was 40% of the inner capacity of the ink tank 82 and an air layer 74 as large as a half of the inner capacity of the main ink chamber 84 was formed in the main ink chamber 84. The air layer was generated by air moving through the meniscus forming portion 90 to the inside of the main ink chamber 84, as described with reference to FIGS. 22A and 22B.

The ink negative pressure value at the ink jet head 81 in the state before pressure reduction, namely, in the state of 1 atmosphere is negative pressure of 60 mm $H_2O$. As the ambient atmospheric pressure is reduced gradually, the negative pressure value in the ink tank 82 lessens relatively. At the time, the pressure of the air layer 74 in the main ink chamber 84 increases relatively and the air layer 74 expands, as described above. Thus, ink starts moving from the main ink chamber 84 to the sub ink chamber 86 through the ink leading portion 91 formed under and in contact with the meniscus forming portion 90. The ink moving to the sub ink chamber 86 is absorbed in the absorption member 89. Since ink is again supplied to the absorption member 89, the interfacial tension with the ink is determined by the inter-fiber gap diameter of the absorption member 89. At the time, it is considered that the ink negative pressure value corresponding to the ink amount in the sub ink chamber 86 affects the ink jet head 81 according to the ink static pressure curve before bubble generation starts shown in FIG. 20.

In FIG. 23, the negative pressure value at the ink jet head 81 is held 20 mm $H_2O$ or more by the fact that ink moves from the main ink chamber 84 to the sub ink chamber 86 until the atmospheric pressure becomes 0.8 atmospheres. If the atmospheric pressure falls below the value, the amount of ink moving to the sub ink chamber 86 exceeds the amount in which the absorption member 89 can hold negative pressure; negative pressure cannot be held and the negative pressure value at the ink jet head 81 lowers rapidly, causing ink to leak. At the time, the atmospheric pressure at which ink leaks can be furthermore lowered by increasing the ink holding capacity of the absorption member 89. Thus, resistance to outer atmospheric pressure change or outer temperature change changes by changing the capacity ratio of the main ink chamber 84 to the absorption member 89 in the sub ink chamber 86.

In the description of the volume efficiency given above, the capacity ratio of the main ink chamber 84 to the sub ink chamber 86 is 1:1. The ink holding efficiency of the absorption member 89 in the sub ink chamber 86 is, for example, about 80% rather than 100%. Thus, preferably the capacity of the absorption member 89 is small if the volume efficiency of the ink supply device is considered. However, if the change in atmospheric pressure described above is considered, the capability of absorbing the atmospheric pressure change would be enhanced with a larger capacity of the absorption member 89. Therefore, the capacities of the main ink chamber 84 and the absorption member 89 should be determined from the viewpoints of both the ink use efficiency and resistance to outer atmospheric pressure change and outer temperature change.

The capacity ratio of the main ink chamber 84 to the sub ink chamber 86 will be preliminarily calculated under certain conditions. Here, cases where the atmospheric pressure lowers and the ambient temperature rises are considered. In the opposite cases, there is no problem because the air layer 74 in the main ink chamber 84 shrinks and negative pressure is held as ink is consumed normally. In the description to follow, assume that atmospheric pressure change is within 0.15 atmospheres and that temperature change ranges from 25 to 70° C. Let the capacity of the main ink chamber 84 be X and that of the absorption member 89 in the sub ink chamber 86 be Y.

Assume that the initial static pressure at the ink jet head 81 is 50 mm $H_2O$. One atmosphere is 10332 mm $H_2O$. Assuming that ink leakage occurs when the static pressure at the ink jet head 81 becomes negative, the atmospheric pressure change until the ink leakage occurs is consumed to relieve the initial negative pressure. Therefore, the change amount in the atmospheric pressure is $$0.15-0.005=0.145 \text{ (atm)}$$

The subsequent change can be thought of constant pressure volume change. Assuming that P×V=nRT=constant (where P is atmospheric pressure, V is volume, R is a gas constant, and T is absolute temperature), the ink leakage amount is considered to be equivalent to the volume change. Here, assuming that the volume after change is V' and that the amount of change is DV', $$V'=1.145\ V$$

$$DV'=0.145\ V$$

The temperature change (from 25° C.(T) to 70° C.(T')) also contributes to volume expansion. Thus, assuming that the volume after change is V" and that the amount of change is DV", $$V''=(T'/T)V=(343/298)V=1.15\ V$$

$$DV''=0.15\ V$$

Here, the change in vapor pressure of ink also contributes to volume expansion. Thus, assuming that the volume after change is V'" and that the amount of change is DV'", $$DV'''=(0.31-0.03)V=0.28\ V$$

Assuming that the volume change when the effects of the atmospheric pressure change, temperature change, and vapor pressure change are considered is DV"", $$DV'''' = DV' + DV'' + DV'''$$

$$= 0.145V + 0.15V + 0.28V = 0.575V$$

Thus, the volume expansion becomes 0.575×X.

Assuming that the total capacity of the main ink chamber 84 and the absorption member 89 is 1, $$X+Y=1$$

Assuming that the actual use efficiency of the absorption member 89 is 56%, the following two relations must hold in order to absorb the volume expansion:

$$0.56\ Y^3\ 0.575\ X$$

$$Y^3\ 1.03\ X\ (>>X)$$

If these relational expressions are substantially satisfied and the capacity of the main ink chamber 84, X, is made as large as possible, the capacity ratio of the main ink chamber 84 to the absorption member 89 becomes substantially 50%:50%. At the time, the ink holding efficiency H, the use efficiency S, and the actual use efficiency J are $$H=50+50\times0.8=90(\%)$$

$$S=50+50\times0.7=85(\%)$$

$$J=S\times H=0.9\times0.85=77(\%)$$

In the calculation, the allowable atmospheric pressure change is 0.15 atm and temperature change is 25° C. to 70° C. If these allowable values are changed, the capacity ratio of the main ink chamber 84 to the absorption member 89 changes. In the calculation, various conditions such as the ink holding capability of the absorption member 89, the static pressure at the ink jet head 81, and the ink vapor pressure are assumed; the capacity ratio of the main ink chamber 84 to the absorption member 89 may be determined based on the conditions.

FIG. 24 is a sectional view showing an ink supply device according to another embodiment of the invention. Parts identical with or similar to those previously described with reference to FIG. 14 are denoted by the same reference numerals in FIG. 24 and will not be discussed again. Numeral 75 is a filter and numeral 76 is a buffer. The embodiment is the same as the embodiment shown in FIG. 14 except that the filter 75 and the buffer 76 are inserted between a main ink chamber 84 and a supply passage 92. The filter 75 is located under the buffer 76, whereby filtering is enabled at the end of the supply passage 92 leading to an ink jet head 81 and dust, foreign material, etc., can be removed securely. The filter 75 is bonded to the top of the supply passage 92 by ultrasonic welding, thermal welding, or the like. Meshes having the filtration grain size ranging from 5 mm to 50 mm, base substance provided by forming SUS thread like felt and further compressing and sintering it, or the like can be used as material of the filter 75. The filtration grain size is determined in the degree to which foreign material larger than the ink flow path diameter in the ink jet head 81 is trapped.

The relationship between a meniscus forming portion 90 and the filter 75 is determined so that the former becomes coarser than the latter. For example, the filtration precision of the meniscus forming portion 90 can be set to 70 mm and that of the filter 75 can be set to 20 mm. When the ink supply device is allowed to stand in a condition such as lateral placement, ink may be out of contact with the meniscus forming portion 90 or the filter 75 if the remaining amount of ink is small. When the outer temperature rises or the outer atmospheric pressure decreases in the state and the negative pressure in the main ink chamber 84 lessens relatively, ink does not move to an absorption member 89 and the inner pressure of the main ink chamber 84 rises considerably. Capillary attraction generated by the meniscus in the meniscus forming portion 90 is made smaller than capillary attraction generated by the meniscus formed on nozzles of the ink jet head 81 or the filter 75, whereby expanded air destroys the meniscus in the meniscus forming portion 90 and moves to a sub ink tank 86, thus preventing ink from leaking from the ink jet head nozzles. The filter 75 also has the effect of suppressing excessive pressure change given to the ink jet head 81 when vibration, shock, or acceleration occurs.

The buffer 76 is made of material such as inner cotton material provided by bundling polyester fiber in one direction like the absorption member 89. Preferably, the buffer 76 is located just before the port of the supply passage 92; it prevents pressure change caused by vibration, shock, or acceleration and bubble mixing from the nozzles of the ink jet head 81.

FIGS. 25A and 25B are schematic structural diagrams of an ink jet recording unit using the ink supply device of the invention. In the figure, numeral 121 is an ink jet recording unit, numeral 122 is an ink tank, numeral 123 is a radiating plate, numeral 124 is a flow path forming member, numeral 125 is a board, numeral 126 is an ink jet head, numeral 127 is a wiring pad, numeral 128 is a sub ink chamber, numeral 129 is an air communication hole, numeral 130 is an absorption member, numeral 131 is an ink leading portion, numeral 132 is a main ink chamber, and numeral 133 is a meniscus forming portion.

The ink jet recording unit 121 consists of components such as the ink tank 122, the radiating plate 123, the flow path forming member 124, the board 125, the ink jet head 126, and the wiring pad 127. The ink tank 122 consists of the sub ink chamber 128, the air communication hole 129, the absorption member 130, the ink leading portion 131, the main ink chamber 132, and the meniscus forming portion 133. The ink jet head 126 and the board 125 are located on the radiating plate 123 and electric connection is made by wire bond, etc. Electric signals from a recording apparatus (not shown) are transferred via the wiring pad 127 on the board 125. A drive circuit, etc., is located on the board 125 for controlling a heating element mounted on the ink jet head 126 for spouting ink through the nozzles. On the other hand, ink is supplied from the ink tank 122, as described above. Ink supplied from the ink tank 122 is sent to the ink jet head 126 via an ink supply passage defined by the flow path forming member 124, and is spouted through the nozzles of the ink jet head 126 for printing.

The ink jet recording unit 121 shown in FIGS. 25A and 25B comprises the ink tank 122 integral with the ink jet head 126; the ink supply device of the invention can be used to provide a compact recording unit which is good in ink use efficiency. In such a form, the ink jet recording unit 121 is mounted detachably on the recording apparatus. Thus, when the ink tank 122 runs out of ink, the ink jet head 126 will also be replaced. However, since the available ink amount can be increased as compared with former ink tanks, the replacement interval can be prolonged, reducing costs and lessening wastes. Of course, the ink tank 122 can also be made a separate unit for unit replacement.

As described above, according to the invention, the ink supply device, which comprises the main ink chamber for storing ink in the ink tank, the sub ink chamber containing the absorption member, the meniscus forming portion, and the ink leading portion, can lead air into the main ink chamber in response to a pressure fall in the ink chamber as ink is consumed by printing for keeping an ink pressure change affecting the ink jet head within a proper range for always providing good picture quality. Ink in the sub ink chamber can be consumed up and even when the main ink chamber contains a small amount of ink, a pressure change in the main ink chamber can be suppressed for printing for improvement in use efficiency of ink. Further, even if pressure in the main ink chamber changes as the environment changes, ink does not leak and appropriate pressure can be maintained for good printing.

As seen from the description given so far, according to the invention, the entry of bubbles into the print head can be prevented without increasing flow path resistance for recording with good picture quality. Since the ink guide member is pressed by the ink guide member retainers and ink is reliably supplied to the meniscus formation member, a problem wherein the ink guide member falls down and it is made impossible to consume all ink in the intermediate ink chamber is solved. Further, placement of the ink guide member is adjusted or a wall is provided, thereby suppressing a move of bubbles to the print head and preventing image quality degradation by the entry of bubbles into the print head for providing a stable and high image quality.

What is claimed is:

1. An ink supply unit for supplying ink to a print head, comprising:

a first ink chamber formed with an atmospheric communication port in an upper side thereof and a communication hole for supplying ink in a lower side thereof, the first ink chamber defining a longitudinal axis in an ink flow direction through the communication hole;

a capillary member for holding ink disposed in the ink chamber;

a meniscus formation member disposed in the first ink chamber that covers the communication hole, the meniscus formation member being separate from and in contact with the capillary member and having a bottom face that includes a plurality of holes;

a second ink chamber horizontally adjacent to the first ink chamber on one side of the longitudinal axis;

a communication passage connecting a lower portion of the second ink chamber to the communication hole;

a joint port on an opposite side of the longitudinal axis and connecting the first ink chamber, the communication passage and the second ink chamber to the print head;

the communication passage being defined by at least an upper wall between the second ink chamber and the communication hole that slants upward from the communication hole to the second ink chamber, the communication passage and the first ink chamber enclosing the meniscus formation member;

a porous ink guide member that contacts the bottom face of the meniscus formation member and extends toward a bottom of the communication passage, an area of a contact region between the porous ink guide member and the meniscus formation member being smaller than an area of the communication hole; and at least one holding member that contacts and holds the ink guide member, wherein there is an ink path outside the ink guide member between the communication passage and the bottom face of the meniscus formation member.

2. An ink supply unit for supplying ink to a print head, comprising:

a main ink chamber formed with an atmospheric communication port and a communication hole for supplying ink;

a capillary member being housed in said main ink chamber for holding ink;

a meniscus formation member separate from said capillary member, said meniscus formation member being disposed in contact with a periphery of said communication hole and with said capillary member, having a bottom face and being formed with a plurality of minute holes;

an intermediate ink chamber;

a communication passage connecting said intermediate ink chamber to said communication hole, said communication passage having a joint port that connects said main ink chamber and said intermediate ink chamber to the print head, said communication passage and said main ink chamber enclosing said meniscus formation member, the communication passage being defined by at least an upper wall between said intermediate ink chamber and said communication hole, the upper wall slanting upward from said communication hole to said intermediate ink chamber;

an ink guide member made of a porous member in contact with said bottom face of said meniscus formation member and extending toward a bottom of said communication passage, an area of a contact region between said ink guide member and said meniscus formation member being smaller than an area of said communication hole; and at least one holding member for holding said ink guide member, wherein the communication hole opens into a bore having a side wall, and wherein said at least one holding member is made up of a plurality of protrusion members extending radially from said side wall and being placed so that a smaller number of said protrusion members are placed on a portion of the periphery of said communication hole adjacent to said upper wall of said communication passage than are placed on an opposite portion of the periphery of said communication hole.

3. An ink supply unit as claimed in claim 2 wherein said communication hole is located between said intermediate ink chamber and said joint port.

4. An ink supply unit as claimed in claim 2 wherein said upper wall is a first upper wall and said communication passage is further defined by at least a second upper wall, said second upper wall extending from said communication hole on a side of said communication hole opposite said first upper wall.

5. An ink recording apparatus, comprising:

a print head;

an ink supply unit for supplying ink to said print head, said ink supply unit comprising:

a main ink chamber formed with an atmospheric communication port and a communication hole for supplying ink;

a capillary member being housed in said main ink chamber for holding ink;

a meniscus formation member separate from said capillary member, said meniscus formation member being disposed in contact with a periphery of said communication hole and with said capillary member, having a bottom face and being formed with a plurality of minute holes;

an intermediate ink chamber;

a communication passage connecting said intermediate ink chamber to said communication hole, said communication passage having a joint port that connects said main ink chamber and said intermediate ink chamber to the print head, said communication passage and said main chamber enclosing said meniscus formation member, the communication passage being defined by at least an upper wall between said intermediate ink chamber and said communication hole, the upper wall slanting upward from said communication hole to said intermediate ink chamber;

an ink guide member being made of a porous member in contact with said bottom face of said meniscus formation member and extending toward a bottom of said communication passage, an area of a contact region between said ink guide member and said meniscus formation member being smaller than an area of said communication hole; and at least one holding member for holding said ink guide member, wherein the communication hole opens into a bore having a side wall, and wherein said at least one holding member is made up of a plurality of protrusion members extending radially from said side wall and being placed so that a smaller number of said protrusion members are placed on a portion of the periphery of said communication hole adjacent to said upper wall of said communication passage then are placed on an opposite portion of the periphery of said communication hole.

6. An ink jet recording apparatus as claimed in claim 5 wherein said communication passage includes a lower side and said joint port is disposed generally opposite said communication hole in said lower side.

7. An ink recording apparatus as claimed in claim 5 wherein said upper wall is a first upper wall and said communication passage is further defined by a second upper wall, said second upper wall extending from said communication hole on a side of said communication hole opposite said first upper wall.

8. An ink supply unit for supplying ink to a print head, comprising:

a first ink chamber formed with an atmospheric communication port in an upper side thereof and a communication hole for supplying ink in a lower side thereof, the first ink chamber defining a longitudinal axis in an ink flow direction through the communication hole;

a capillary member for holding ink disposed in the ink chamber;

a meniscus formation member disposed in the first ink chamber that covers the communication hole, the meniscus formation member being separate from and in contact with the capillary member and having a bottom face that includes a plurality of holes;

a second ink chamber horizontally adjacent to the first ink chamber on one side of the longitudinal axis, the second ink chamber being disposed above the communication hole;

a communication passage connecting a lower portion of the second ink chamber to the communication hole;

a joint port on an opposite side of the longitudinal axis that connects the first ink chamber, the communication passage and the second ink chamber to the print head, the joint port having an upper portion, the communication passage being defined by an upper wall and a lower wall, the upper wall guiding air bubbles in the ink in a first direction from the upper portion of the joint port to the second ink chamber, the upper wall being defined by an external wall of the first ink chamber and including an inclined portion between the second ink chamber and the communication hole that slants upward from the communication hole to the second ink chamber, the lower wall guiding ink from the second ink chamber to the joint port in a second direction opposite to the first direction, the lower wall being opposite to the upper wall;

a porous ink guide member that contacts the bottom face of the meniscus formation member and extends toward a bottom of the communication passage, an area of a contact region between the porous ink guide member and the meniscus formation member being smaller than an area of the communication hole; and at least one holding member that contacts and holds the ink guide member, wherein there is an ink path outside the ink guide member between the communication passage and the bottom face of the meniscus formation member.

* * * * *